US006804475B2

(12) United States Patent
Oguma et al.

(10) Patent No.: US 6,804,475 B2
(45) Date of Patent: Oct. 12, 2004

(54) PROCESS CARTRIDGE COMPRISING GROUNDING, CHARGING BIAS, AND DEVELOPING BIAS CONTACTS AND INPUT AND OUTPUT CONTACTS, AND ELECTROPHOTOGRAPHIC IMAGE FORMING APPARATUS TO WHICH THE PROCESS CARTRIDGE IS DETACHABLY MOUNTABLE

(75) Inventors: Toru Oguma, Mishima (JP); Toshiyuki Karakama, Shizuoka-ken (JP); Akiyoshi Yokoi, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/091,287

(22) Filed: Mar. 6, 2002

(65) Prior Publication Data

US 2002/0172521 A1 Nov. 21, 2002

(30) Foreign Application Priority Data

Mar. 9, 2001 (JP) ..... 2001/066213

(51) Int. Cl.[7] ..... G03G 15/08

(52) U.S. Cl. ..... 399/27; 399/119; 399/111

(58) Field of Search ..... 399/9, 24, 27, 399/30, 61, 62, 63, 111, 119, 88, 90, 107

(56) References Cited

U.S. PATENT DOCUMENTS

| | | | |
|---|---|---|---|
| 4,591,258 | A | 5/1986 | Nishino et al. |
| 4,924,267 | A | 5/1990 | Yoshikawa et al. |
| 5,047,803 | A | 9/1991 | Kanoto |
| 5,126,789 | A | 6/1992 | Fukuchi et al. |
| 5,142,322 | A | 8/1992 | Surti |
| 5,177,529 | A | 1/1993 | Schroll et al. |
| 5,331,373 | A | 7/1994 | Nomura et al. |
| 5,463,446 | A | 10/1995 | Watanabe et al. |
| 5,500,714 | A | 3/1996 | Yashiro et al. |
| 5,510,878 | A | 4/1996 | Noda et al. |

(List continued on next page.)

FOREIGN PATENT DOCUMENTS

| | | |
|---|---|---|
| EP | 0 281 372 | 9/1988 |
| EP | 0 285 139 | 10/1988 |
| EP | 0 466 173 | 1/1992 |
| EP | 0 468 751 | 1/1992 |
| EP | 0 572 738 | 12/1993 |
| EP | 0 586 041 | 3/1994 |
| EP | 0 586 046 | 3/1994 |
| EP | 1 016 939 A2 * | 12/1999 |
| JP | 2-163761 | 6/1990 |
| JP | 4-18920 | 1/1992 |
| JP | 6-19242 | 1/1994 |
| JP | 6-83123 | 3/1994 |
| JP | 6-208260 | 7/1994 |
| JP | 6-317961 | 11/1994 |
| JP | 2000-250380 | 9/2000 |
| WO | WO 92/18910 | 10/1992 |

*Primary Examiner*—Hoang Ngo
(74) *Attorney, Agent, or Firm*—Fitzpatrick, Cella, Harper & Scinto

(57) ABSTRACT

A process cartridge detachably mountable to a main assembly of an electrophotographic image forming apparatus includes an electrophotographic photosensitive drum; a charging roller for charging the drum; a developing roller for developing an image formed on the drum; an input electrode; an output electrode; a grounding contact for grounding the drum; a charging bias contact receiving a charging bias voltage applied to the charging roller; a developing bias contact receiving a developing bias applied to the developing roller; an input electrical contact for receiving an input bias applied to the input electrode; and an output contact for transmitting, to the main assembly, an output corresponding to electrostatic capacities between the input and output electrodes and between the developing roller and the output electrode to detect in substantially real time a remaining amount of developer in the cartridge.

19 Claims, 12 Drawing Sheets

U.S. PATENT DOCUMENTS

| | | | | |
|---|---|---|---|---|
| 5,543,898 | A | 8/1996 | Shishido et al. | |
| 5,585,889 | A | 12/1996 | Shishido et al. | |
| 5,614,992 | A | 3/1997 | Kikuchi et al. | 399/124 |
| 5,617,579 | A | 4/1997 | Yashiro et al. | 399/114 |
| 5,640,649 | A | 6/1997 | Kikuchi et al. | 399/111 |
| 5,652,647 | A | 7/1997 | Yashiro et al. | 399/111 |
| 5,689,774 | A | 11/1997 | Shishido et al. | 399/111 |
| 5,768,660 | A | 6/1998 | Kurihara et al. | 399/111 |
| 5,873,012 | A | 2/1999 | Miyabe et al. | 399/90 |
| 6,070,028 | A | 5/2000 | Odagawa et al. | 399/104 |
| 6,097,909 | A | 8/2000 | Watanabe et al. | 399/111 |
| 6,128,452 | A | 10/2000 | Miyabe et al. | 399/90 |
| 6,253,036 | B1 | 6/2001 | Karakama et al. | 399/27 |
| 6,272,299 | B1 | 8/2001 | Numagami et al. | 399/111 |
| 6,330,402 | B1 | 12/2001 | Sakurai et al. | 399/12 |
| 6,377,759 | B1 | 4/2002 | Abe et al. | 399/27 |
| 2002/0012542 | A1 | 1/2002 | Karakama, et al. | 399/27 |

* cited by examiner

PROCESS CARTRIDGE COMPRISING GROUNDING, CHARGING BIAS, AND DEVELOPING BIAS CONTACTS AND INPUT AND OUTPUT CONTACTS, AND ELECTROPHOTOGRAPHIC IMAGE FORMING APPARATUS TO WHICH THE PROCESS CARTRIDGE IS DETACHABLY MOUNTABLE

FIELD OF THE INVENTION AND RELATED ART

The present invention relates to a process cartridge and an electrophotographic image forming apparatus.

An electrophotographic image forming apparatus is an apparatus which forms an image on recording medium with the use of an electrophotographic image formation method. As for the examples of an electrophotographic image forming apparatus, an electrophotographic copying machine, an electrophotographic printer (laser beam printer, LED printer, or the like), a facsimile machine, a word processor, or the like, are included.

A process cartridge is a cartridge in which a charging means, a developing means or cleaning means, and an electrophotographic photoconductive drum, are integrally disposed, and which is removably mountable in the main assembly of an electrophotographic image forming apparatus. It also is a cartridge in which at least one means among a charging means, a developing means, and a cleaning means, and an electrophotographic photoconductive drum, are integrally disposed, and which is removably mountable in the main assembly of an electrophotographic image forming apparatus, or a cartridge in which a minimum of a developing means, and an electrophotographic photoconductive member, are integrally disposed, and which is removably mountable in the main assembly of an electrophotographic image forming apparatus.

An electrophotographic image forming apparatus, which employs an electrophotographic image formation process, also employs a process cartridge system, in which an electrophotographic photoconductive member, and a single, or a plurality of, processing means, which act on the electrophotographic photoconductive drum, are integrally disposed in a cartridge which is removably mountable in the main assembly of an electrophotographic image forming apparatus. This system enables a user to maintain the apparatus without relying on service personnel, drastically improving operational efficiency. Thus, a process cartridge system is widely in use in the field of an electrophotographic image forming apparatus.

In the case of an electrophotographic image forming apparatus employing a process cartridge system, a user him/herself replaces a cartridge. Therefore, some of the electrophotographic image forming apparatuses are equipped with a developer amount detecting means for informing the user of the remaining amount of the developer. As for a developer amount detecting means, there is a method in which a plurality of electrodes are disposed within a process cartridge, and the changes in the electrostatic capacity among the electrodes are detected to estimate the remaining amount of the developer.

According to a process cartridge system, as a cartridge is inserted into the apparatus main assembly, an electrical connection must be established between the cartridge and apparatus main assembly. Therefore, a cartridge is provided with electrical contacts (for example, U.S. Pat. No. 6,272,299).

According to U.S. Pat. No. 6,272,299, the electrical contacts are optimally positioned to reduce in size a process cartridge and an electrophotographic image forming apparatus.

The present invention is a result of the further development of the aforementioned prior arts regarding the positioning of the electrical contacts of a process cartridge and an electrophotographic image forming apparatus.

SUMMARY OF THE INVENTION

The primary object of the present invention is to provide a smaller process cartridge which contains input and output electrical contacts which make it possible for the remaining amount of the developer to be continually detected by the image forming apparatus main assembly side, and an electrophotographic image forming apparatus in which such a process cartridge can be removably mounted.

Another object of the present invention is to provide a smaller process cartridge, which contains input and output electrical contacts which make it possible for the remaining amount of the developer to be continually detected by the image forming apparatus main assembly side, and in which the input and output electrical contacts are positioned at one of the lengthwise ends of the process cartridge to improve the accuracy with which the remaining amount of the developer is detected by the image forming apparatus main assembly side, and an electrophotographic image forming apparatus in which such a process cartridge can be removably mounted.

Another object of the present invention is to provide a smaller process cartridge, the size of which is realized by optimally positioning the electrical contacts, inclusive of both input and output electrical contacts, and an electrophotographic image forming apparatus in which such a process cartridge can be removably mountable.

Another object of the present invention is to provide a process cartridge in which various electrodes thereof are disposed at one end of the process cartridge in terms of the lengthwise direction of the electrophotographic photoconductive member to make it possible to reduce the size of the high voltage circuit on the image forming apparatus main assembly side, and an electrophotographic image forming apparatus in which such a process cartridge can be removably mounted.

According to an aspect of the present invention, there is provided a process cartridge detachably mountable to a main assembly of an electrophotographic image forming apparatus comprising an electrophotographic photosensitive drum; a charging roller for electrically charging the electrophotographic photosensitive drum; a developing roller for developing an electrostatic latent image formed on the electrophotographic photosensitive drum; an input electrode extending along a longitudinal direction of the developing roller; an output electrode extending along a longitudinal direction of the developing roller; a grounding contact for electrically grounding the photosensitive drum to a main assembly of the apparatus when the cartridge is mounted to the main assembly of the apparatus, the grounding contact being exposed at an end surface of a cartridge frame provided at one longitudinal end of the photosensitive drum and being disposed across an axis of the photosensitive drum; a charging bias contact for receiving a charging bias voltage to be applied to the charging roller from the main assembly of the apparatus when the cartridge is mounted to the main assembly of the apparatus, the charging bias contact being exposed and facing downwardly adjacent one longitudinal end of the photosensitive drum when the cartridge is mounted to the main assembly of the apparatus; a developing bias contact for receiving a developing bias to be applied to the developing roller from the main assembly of the apparatus when the cartridge is mounted to the main assembly of the apparatus, the developing bias contact being exposed and facing downwardly adjacent one longitudinal end of the photosensitive drum when the cartridge is mounted to the main assembly of the apparatus, and the developing bias contact being disposed at a side opposite from the charging bias contact with the photosensitive drum interposed therebetween with respect to a direction crossing a longitudinal direction of the photosensitive drum; an input electrical contact for receiving an input bias to be applied to the input electrode from the main assembly of the apparatus when the cartridge is mounted to the main assembly of the apparatus, the input electrical contact being exposed at an end surface of a cartridge frame provided adjacent a longitudinal end of the photosensitive drum; and an output contact for transmitting, to the main assembly of the apparatus, an output produced on the basis of a value corresponding to an electrostatic capacity between the input electrode and the output electrode and an electrostatic capacity between the developing roller and the output electrode to detect in substantially real time the remaining amount of the developer in the cartridge by the main assembly of the apparatus when the cartridge is mounted to the main assembly of the apparatus, the output contact being exposed at an end surface of a cartridge frame provided adjacent a longitudinal end of the photosensitive drum.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

General Description of Image Forming Apparatus

Figure 1:
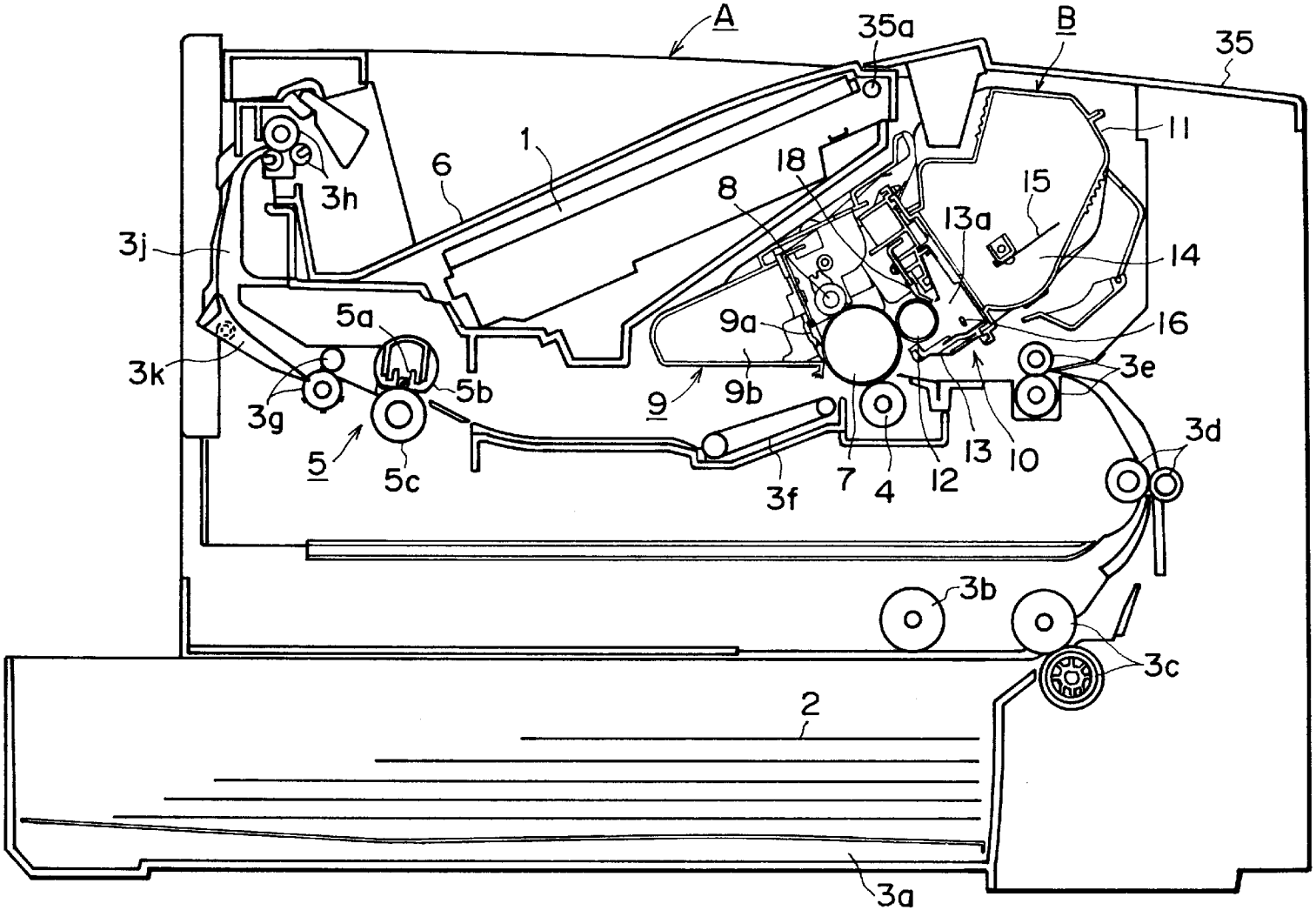
FIG. 1 is a schematic sectional view of an electrophotographic image forming apparatus in an embodiment of the present invention.
Figure 2:
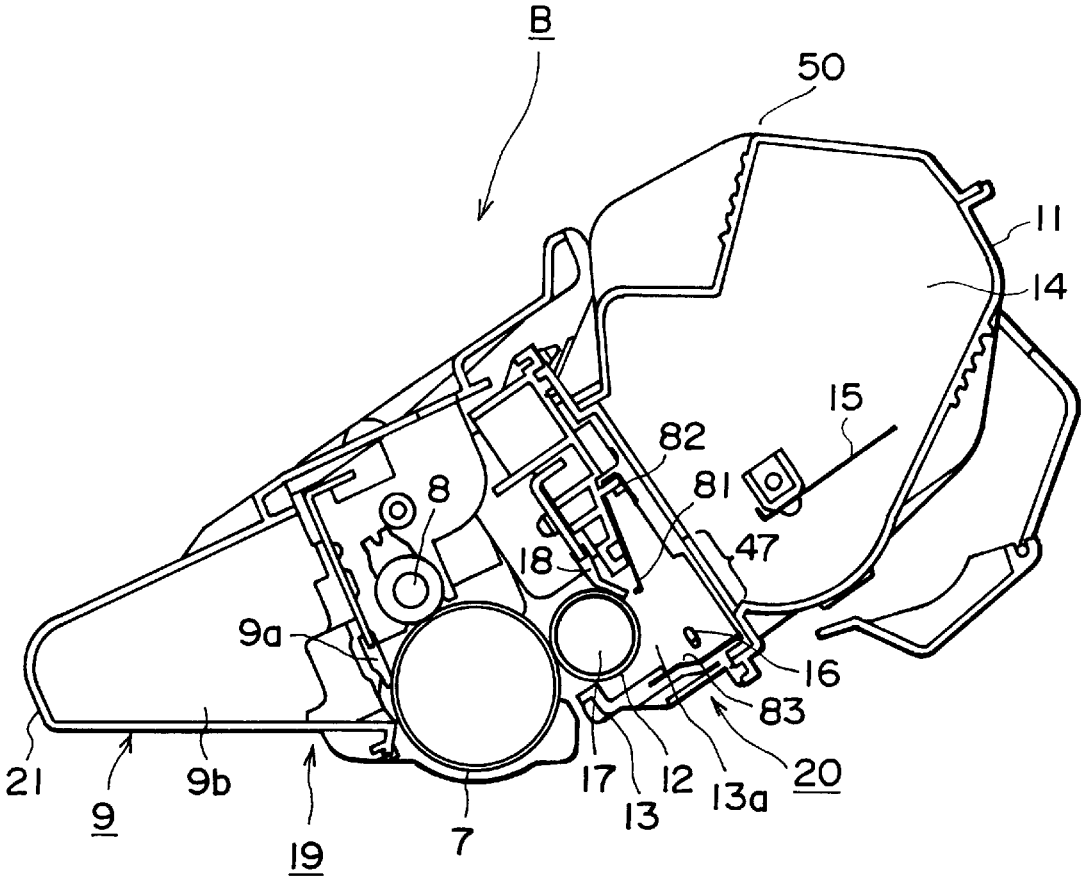
FIG. 2 is a sectional view of the process cartridge in the embodiment of the present invention.

First, an example of an electrophotographic image forming apparatus in which a process cartridge in accordance with the present invention is removably mountable will be described. FIG. 1 is a sectional view of the electrophotographic image forming apparatus A in this embodiment of the present invention, and FIG. 2 is a sectional view of the process cartridge B in this embodiment.

The image forming apparatus A has an electrophotographic photoconductive drum 7 (which hereinafter will be referred to as photoconductive drum). The photoconductive drum 7 is charged by a charge roller 8 as a charging means, and is exposed to a beam of laser light emitted, while being modulated with the image formation information, from an optical means 1 comprising a laser diode, a polygon mirror, a lens, a deflection mirror, and the like. As a result, an electrostatic latent image in accordance with the image formation information, is formed on the peripheral surface of the photoconductive drum 7. This latent image is developed into a developer image, or a visible image, by a developing means.

The developing means comprises a development roller 12 as a developer bearing member for delivering developer to the photoconductive drum 7, and a development blade 18 as a regulating member for regulating the amount by which developer is adhered to the peripheral surface of the development roller 12. The developing means also comprises a developing means holding frame 13 for holding the development roller 12 and development blade 18, and a developer holding frame 11 for holding developer. The developing means holding frame 13 in which the development roller 12 and development blade 18 are held, and the developer holding frame 11 in which developer is held, are joined to form a development unit 20 or a developing apparatus.

The developing means holding frame 13 has a development chamber 13*a*. The developer held in the developer holding portion 14 adjoining the development chamber 13*a* is conveyed toward the development roller 12 in the development chamber 13*a*, by the rotation of a developer conveying member 15. The developing means holding frame 13 is provided with a developer stirring member 16, which is disposed adjacent to the development roller 12 and is rotationally drivable. The developer stirring member 16 circulates the developer within the development chamber 13*a*, after the developer is delivered from the developer holding portion 14. The developer is magnetic, and the development roller 12 contains a stationary magnet 17. Therefore, the developer adheres to the peripheral surface of the development roller 12.

As the development roller 12 is rotated, the developer is conveyed, while being given tribo-electrical charge by the development blade 18. As a result, a developer layer with a predetermined thickness is formed on the peripheral surface of the development roller 12, and is conveyed to the development region of the photoconductive drum 7. In the development region, the developer is transferred onto the areas of the peripheral surface of the photoconductive drum 7, corresponding to the latent image, forming a development image, on the peripheral surface of the photoconductive drum 7. The development roller 12 is connected to a development bias circuit with which the main assembly of the image forming apparatus A is provided. Normally, development bias voltage, which is a combination of AC and DC voltages, is applied to the development roller 12.

Meanwhile, in synchronism with the formation of the aforementioned developer image, a recording medium 2, which has been set in a sheet feeder cassette 3*a*, is delivered to a transfer station by a pickup roller 3*b*, and conveyer roller pairs 3*c*, 3*d*, and 3*e*. In the transfer station, a transfer roller 4 as a transferring means is disposed. As voltage is applied to the transfer roller 4, the developer image on the photoconductive drum 7 is transferred onto the recording medium 2

After receiving the developer image, the recording medium 2 is conveyed to a fixing means 5 by a conveyance guide 3*f*. The fixing means 5 is provided with a driving roller 5*c*, and a fixing roller 5*b* containing a heater 5*a*. As the recording medium 2, onto which the developer image has just been transferred, is passed through the fixing means 5, heat and pressure are applied to the recording medium 2 and the developer image thereon, by the fixing means 5. As a result, the developer image is fixed to the recording medium 2.

Thereafter, the recording medium 2 is further conveyed by discharge roller pairs 3*g* and 3*h*, and then is discharged into a delivery tray 6 through an inverting path 3*j*. The delivery tray 6 constitutes a part of the top surface of the image forming apparatus A. Incidentally, it is possible to pivot a pivotable flapper 3*k* to discharge the recording medium 2 without sending the recording medium 2 through the inverting path 3*j*. In this embodiment, the aforementioned pickup roller 3*b*, conveying roller pairs 3*c*, 3*d*, and 3*e*, conveyance guide 3*f*, and discharge roller pairs 3*g* and 3*h*, together make up a conveying means.

After the transfer of the developer image onto the recording medium 2 by the transfer roller 4, the developer particles remaining on the peripheral surface of the photoconductive drum 7 are removed by a cleaning means 9, preparing the photoconductive drum 7 for the following rotational cycle for image formation. The cleaning means 9 is provided with an elastic cleaning blade 9*a*, which is placed in contact with the peripheral surface of the photoconductive drum 7 to scrape down the developer particles remaining on the peripheral surface of the photoconductive drum 7. The removed developer particles are collected into a removed developer bin 9*b*.

Description of Process Cartridge

Referring to FIG. 2, the process cartridge B in this embodiment comprises the developing means holding frame 13 provided with a developing means, and the developer holding frame 11. The developing means holding frame 13 and developer holding frame 11 are welded to each other, forming a development unit 20 (developing apparatus). The developer holding frame 11 comprises the developer holding portion 14, and a developer outlet or developer supply opening 47 through which the developer in the developer holding portion 14 is supplied to the developing means holding frame 13. Within the developer holding portion 14, a developer conveying member 15 is rotationally supported. The developer outlet 47 remains sealed with a developer seal 48 until the process cartridge B is used for the first time; in other words, when the process cartridge B is used for the first time, the developer seal 48 is pulled out by a user in order to enable the developer to be supplied to the developing means holding frame 13. The developing means holding frame 13 holds the development roller 12 as a developing means, and the development blade 18.

The drum holding frame 21 holds the cleaning means 9 such as the cleaning blade 9*a* or the like, the photoconductive drum 7, and the charge roller 8, making up a cleaning unit 19.

The development unit 20 and cleaning unit 19 are integrally joined into the process cartridge B.

Next, referring to FIG. 3, a method for mounting the process cartridge B into the image forming apparatus main assembly, or dismounting the process cartridge B from the image forming apparatus main assembly, will be described.

Figure 3:
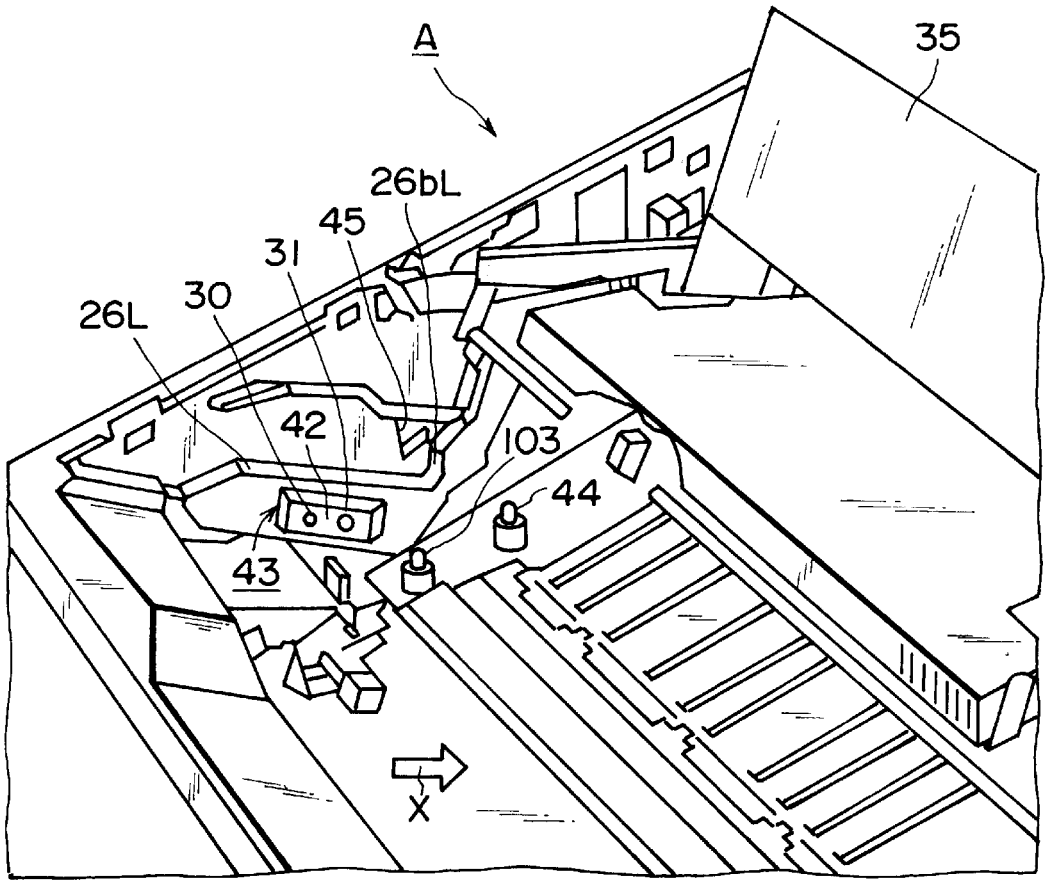
FIG. 3 is a perspective view of the top portion of the image forming apparatus in the embodiment of the present invention, the cover of which is open.

FIG. 3 is a perspective view of the image forming apparatus A, the cover 35 of which is open. The image forming apparatus A is provided with the left and right guide rails 26L and 26R (26R is not shown), which are on the internal surfaces of the left and right side walls, respectively, of the image forming apparatus A, being inclined downward in terms of the direction in which the process cartridge B is inserted. The image forming apparatus A is also provided with the left and right positioning guides or grooves 26*b*L and 26*b*R (26*b*R is not shown). These guide rails 26L and 26R and positioning guides 26*b*L and 26*b*R are exposed as the cover 35 is opened by being rotated about the hinge 35*a* (FIG. 1). In comparison, the process cartridge B is provided with the left and right cylindrical guides, the axial lines of which are in alignment with the axial line of the photoconductive drum 7. It is also provided with the left and right positioning guides, which are long and narrow and are behind the cylindrical guides, one for one, in terms of the direction in which the process cartridge B is inserted into the apparatus main assembly. In order to mount the process cartridge B into the image forming apparatus A, first, the left and right cylindrical guides of the process cartridge B and the left and right positioning guides of the process cartridge B are inserted into the guide rails 26L and 26R, and then, the cylindrical guides are fitted into the corresponding positioning grooves 26*b*L and 26*b*R of the image forming apparatus main assembly A.

On the contrary, in order to dismount the process cartridge B in the image forming apparatus main assembly A, the above described process cartridge mounting steps are carried out in reverse; the process cartridge B is pulled out following the guide rails 26L and 26R.

Description of Cleaning Unit

To the drum holding frame 21, the photoconductive drum 7, the charge roller 8, the cleaning means, and the like, are integrally attached to make up the cleaning unit 19.

Figure 4:
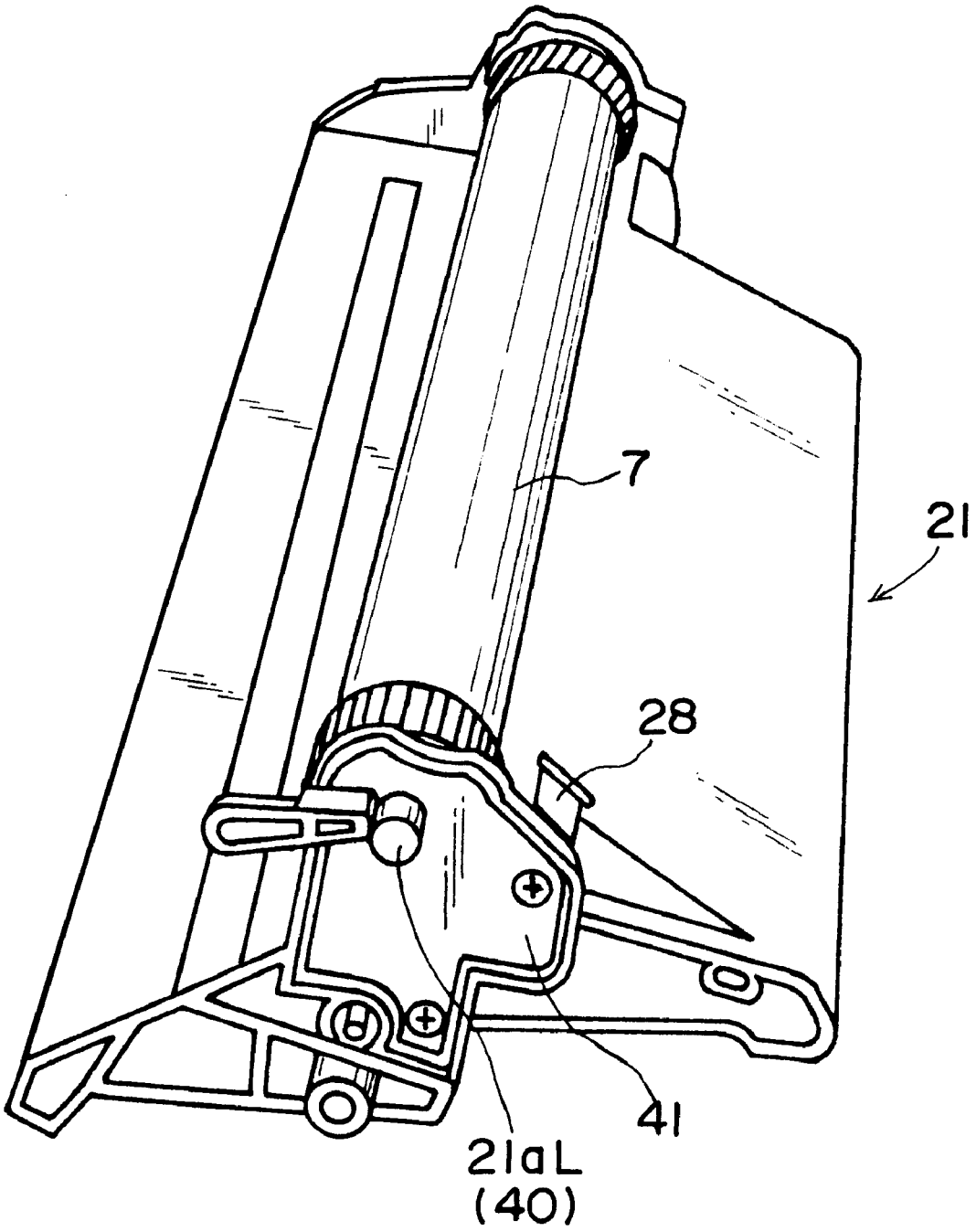
FIG. 4 is a perspective view of the cleaning unit in the embodiment of the present invention, as seen from below.

FIG. 4 is a perspective view of the cleaning unit 19 as seen from below. As is evident from the drawing, the drum holding frame 21 is provided with a plurality of electrical contacts in addition to the aforementioned various components. More specifically, it is provided with: (1) cylindrical guide 21*a*L (which hereinafter will be designated by a reference numeral 40 when it is referred to as a grounding contact) as a grounding contact connected to the photoconductive drum 7 to ground the photoconductive drum 7 through the image forming apparatus main assembly A; and (2) a charge bias electrical contact member 28 connected to the charge roller shaft for applying charge bias to the charge roller 8.

Figure 5:
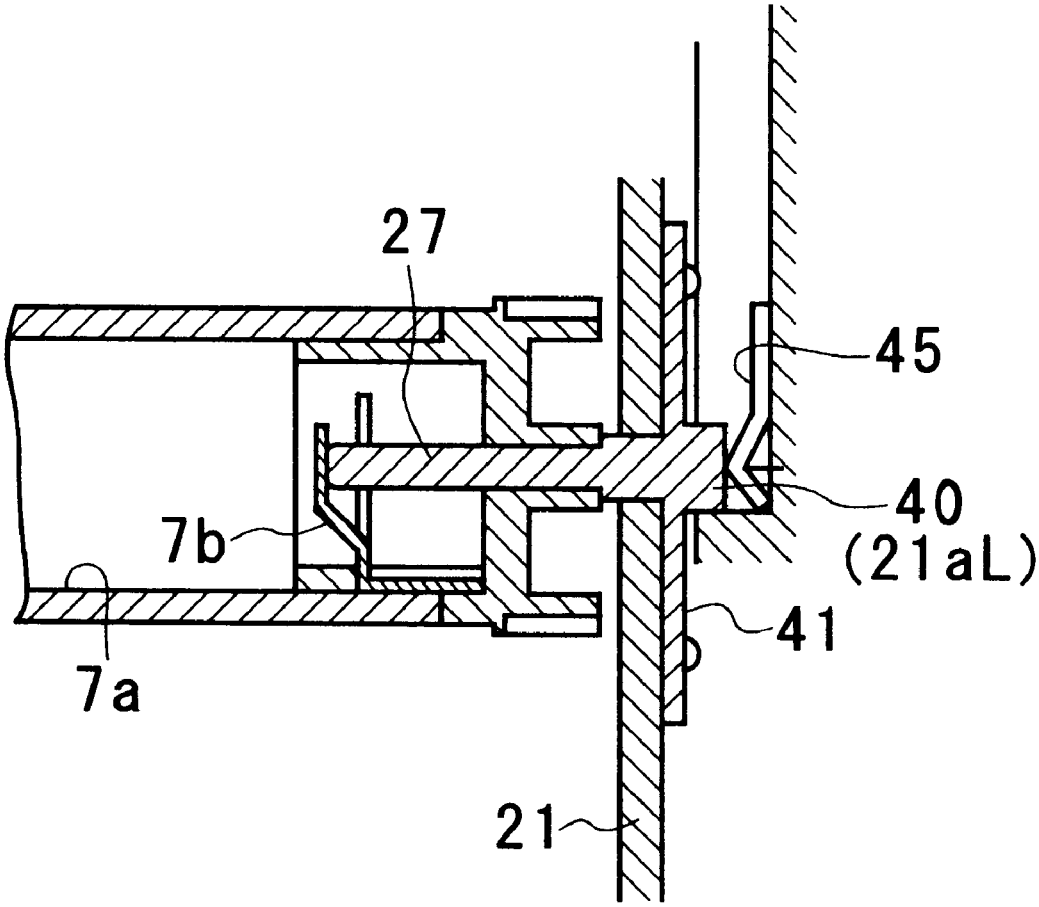
FIG. 5 is a sectional view of the grounding electrical contact of the photoconductive drum in the embodiment of the present invention, for showing the structure thereof.

Referring to FIG. 5, the grounding contact 40 is an integral part of a flange 41 formed of an electrically conductive substance. The flange 41 is also provided with a drum shaft 27, which is also an integral part of the flange 41, and the axial line of which is in alignment with the center of the grounding contact 40. Further, the photoconductive drum 7 comprises a drum cylinder 7*a*, and a grounding plate 7*b* in contact with drum cylinder 7*a*. Thus, the photoconductive drum 7 is kept grounded by keeping a grounding plate 7*b* pressed directly upon the drum shaft 27.

Figure 6:
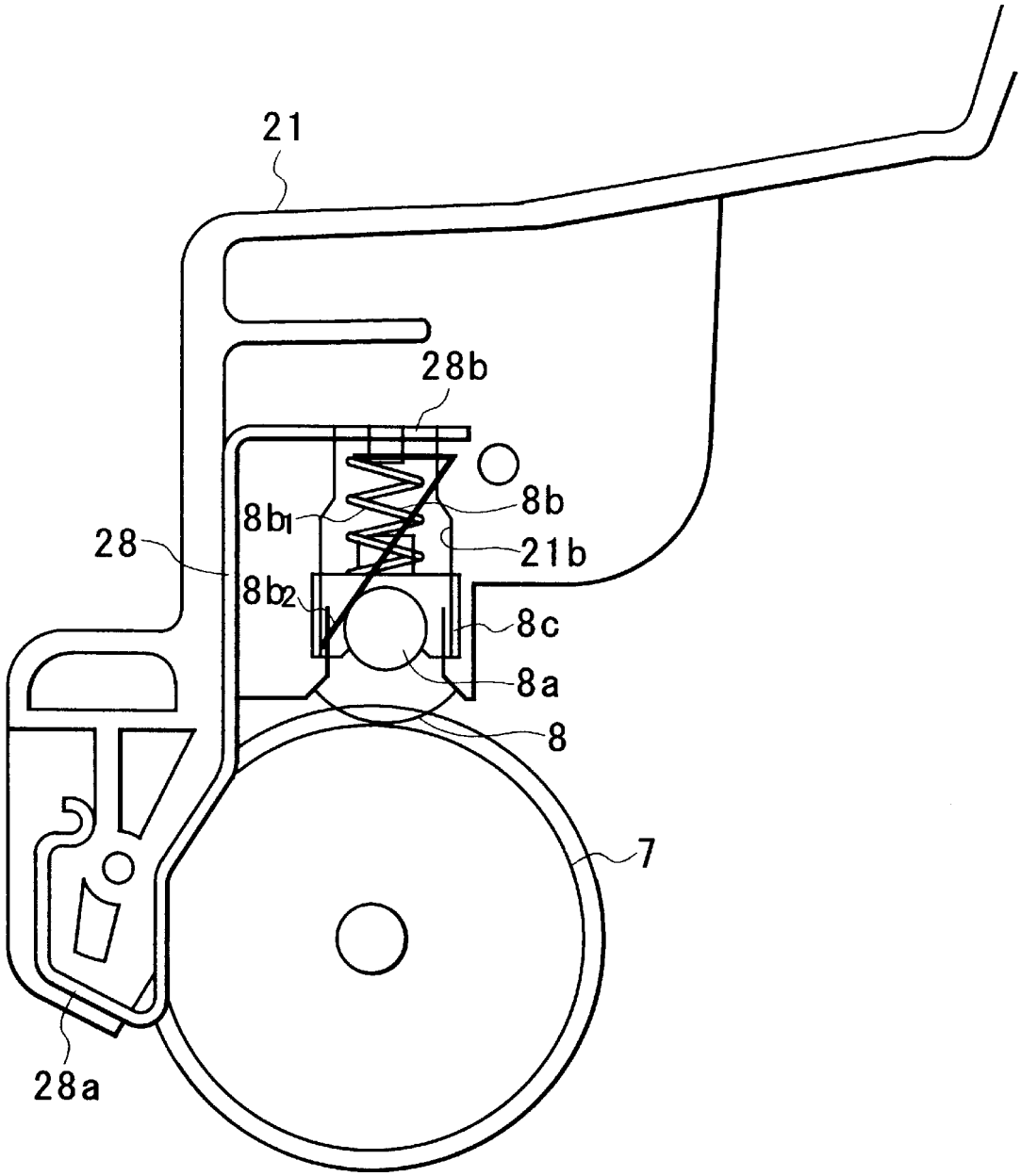
FIG. 6 is a sectional view of the charge bias electrical contact in the embodiment of the present invention, for showing the structure thereof.

Next, referring to FIG. 6, the charge bias electrical contact 28*a* is electrically in contact with the charge roller shaft 8*a* of the charge roller 8 through a compound spring 8*b* in contact with the charge roller shaft 8*a*. This spring 8*b* comprises a coil spring portion 8*b*1 and a straight wire spring portion 8*b*2. The charge bias electrical contact member 28 has the charge bias electrical contact 28*a* and a spring seat 28*b*. Thus, the charge bias received from the apparatus main assembly through the charge bias electrical contact 28*a* is applied to the charge roller 8 through the spring seat 28*b*, coil spring portion 8*b*1, and straight wire spring portion 8*b*2. A charge roller bearing 8*c* is fitted in the guide groove 21*b* of the drum holding frame 21. The charge bias electrical contact 28*a* is attached to the drum holding frame 21 in such a manner that it faces downward when the process cartridge B is in the image forming apparatus main assembly A.

The above described two electrical contacts (grounding contact 40 and charge bias electrical contact member 28) are disposed at the same end of the process cartridge B in terms of the lengthwise direction of the photoconductive drum 7.

Description of Developer Amount Detecting Means

In this embodiment, the process cartridge B is provided with a developer amount detecting means which continually detects the remaining amount of the developer in the developer chamber 13*a* as the developer is consumed.

Referring to FIG. 2, in this embodiment, the developing means holding frame 13 is provided with first, second, and third electrodes 81, 82, and 83, which constitute the measurement electrodes of the developer amount detecting means. These electrodes are disposed in parallel to the development roller 12. More specifically, the first electrode 81 is disposed close, and parallel, to the development roller 12, and the third electrode 83 is attached to the bottom portion of the developing means holding frame 13. The first and third electrodes 81 and 83 are connected to each other within the developing means holding frame 13, being therefore equal in electrical potential level.

The second electrode 82 is disposed closer to the developer holding frame 11 than the first electrode 81, and is disposed in the upper portion of the developing means holding frame 13, opposing the first electrode 81. With the provision of this structural arrangement, as electrical voltage is applied to either the first electrode 81 or second electrode 82, static electricity is induced between the electrodes, and the amount of this static electricity is measured by the detection circuit provided on the image forming apparatus main assembly A side to detect the amount of the developer remaining in the process cartridge B.

More specifically, as developer enters between the electrodes, the electrostatic capacity between the electrodes changes. Thus, the amount of the developer between the electrodes can be detected by detecting the changes in this electrostatic capacity. In this embodiment, the second electrode 82 is used as the input electrode through which voltage is applied, and the first and third electrodes 81 and 83 are used as the output electrodes.

The aforementioned first, second, and third electrodes 81, 82, and 83 are disposed where the developer enters the developing means holding frame 13 after being conveyed toward the developing means holding frame 13 by the developer conveying member 15 in the developer holding frame 11. When there is a substantial amount of developer in the process cartridge B, the developer is pushed into the space surrounded by the electrodes, by the developer conveying member 15, and therefore, the value of the electrostatic capacity between the electrodes remains at a high level. As the use of the process cartridge B continues, the developer therein is continuously consumed, and the level of the developer between the electrodes gradually falls, decreasing, accordingly, the electrostatic capacity between the electrodes. Thus, the remaining amount of the developer can be continually detected based on the reduction in the electrostatic capacity between the electrodes.

In this embodiment, the development bias applied to the development roller 12 is used as the input voltage, and the electrostatic capacity between the development roller 12 and first electrode 81 is detected to detect the state in which there remains no developer in the process cartridge B. In other words, the detecting means is enabled to continually detect the amount of the developer by detecting the changes in the electrostatic capacity.

Description of Detection Circuit

Figure 7:
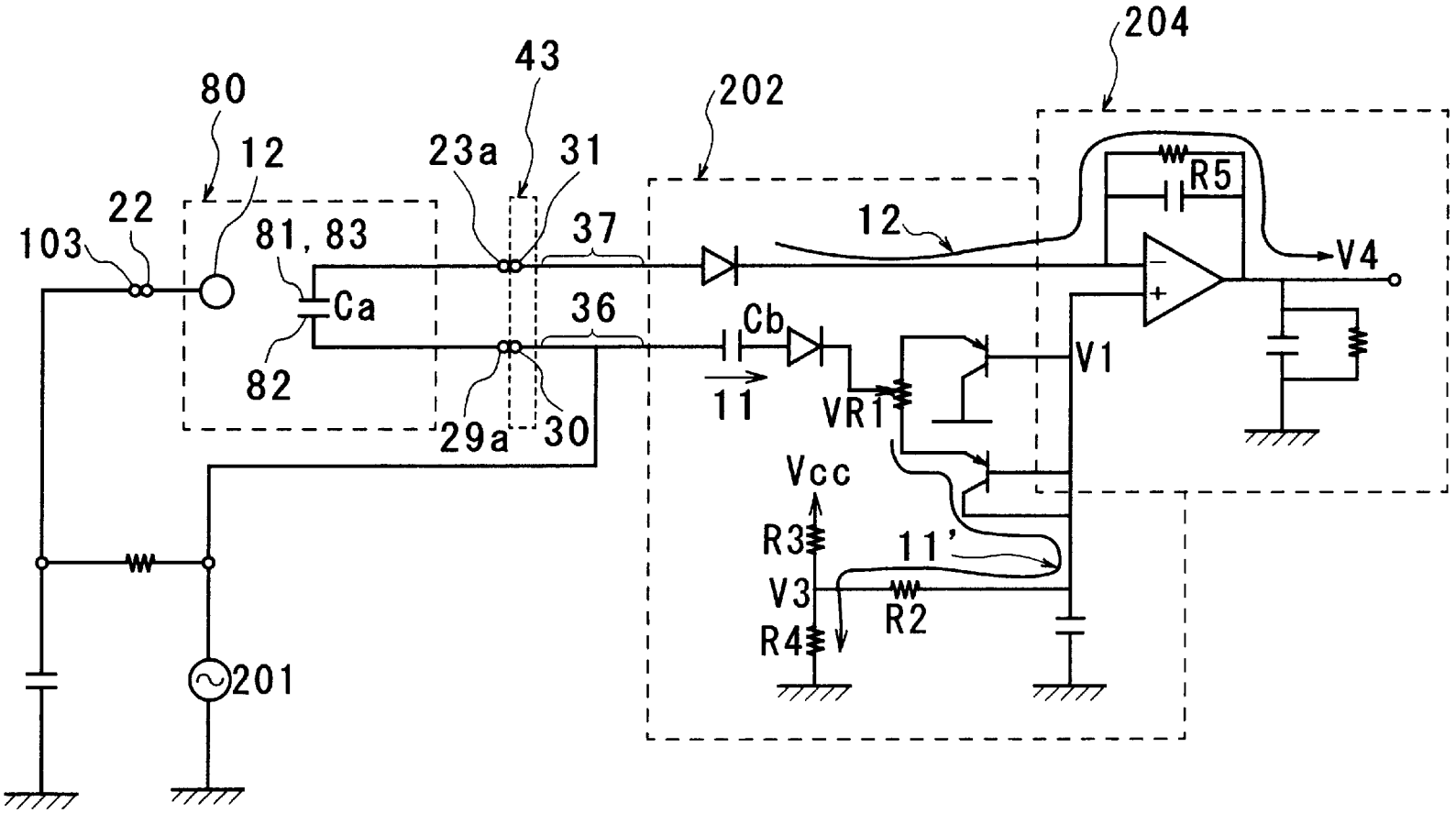
FIG. 7 is a diagram of the developer amount detection circuit in the embodiment of the present invention.

FIG. 7 is a diagram of an example of the developer amount detection circuit in the image forming apparatus in this embodiment.

The developer amount detection circuit 200 comprises a detecting portion 80, a development bias circuit 201, the control circuit 202, and the amplification circuit 204. The detecting portion 80 is made up of the aforementioned first, second, and third electrodes 81, 82, and 83, and the development roller 12. It induces the static electricity used for detecting the developer amount. This detecting portion 80 is on the process cartridge B side.

In comparison, the development bias circuit 201, the control circuit 202, and the amplification circuit 204 are on the image forming apparatus main assembly A side.

The process cartridge B is provided with a development bias electrical contact member 22, which is electrically in contact with the development roller 12, whereas the image forming apparatus main assembly A is provided with an electrical contact 103, which is in contact with the development bias circuit 201. As the process cartridge B is inserted into the image forming apparatus main assembly A, the development bias electrical contact 22*a* of the development bias electrical contact member 22 and the electrical contact 103 on the image forming apparatus main assembly A side, are placed electrically in contact with each other. To the development roller 12, development bias is applied from the development bias circuit 201 of the image forming apparatus main assembly A through the electrical contact 103 and development bias electrical contact 22*a*.

Further, the process cartridge B is provided with an output electrical contact 23*a* and an input electrical contact 29*a*, which constitute the electrical contacts through which an electrical connection is made between the process cartridge B and the image forming apparatus A. These contacts 23*a* and 29*a* are located at one of the end walls of the process cartridge B in terms of the lengthwise direction of the process cartridge B, and come into contact with the electrical contacts 30 and 31 provided on the image forming apparatus A side, as the process cartridge B is mounted into the image forming apparatus main assembly A.

The electrostatic capacity Ca of the detecting portion 80 is the combination of the electrostatic capacity between the second and first electrodes 82 and 81, and the electrostatic capacity between the second and third electrodes 82 and 83. It changes in response to the developer amount.

Regarding the detecting portion 80, the electrode, as an impedance element, on the input side, that is, the second electrode 82 in this embodiment, is connected, through the development bias electrical contact member 22, to the development bias circuit 201 and control circuit 202, which make up the development bias applying means. In this embodiment, the second electrode 82 is the input electrode, and is connected to the development bias circuit 201 through the input electrical contact 29*a* and the electrical contact 30 of the image forming apparatus main assembly A. It is also connected to the control circuit 202 through the power routing member 36 of the image forming apparatus main assembly A.

The other electrodes, or output electrodes, of the detecting portion 80, that is, the first and third electrodes 81 and 83 in this embodiment, are connected to the control circuit 202 through the output electrical contact 23*a*, and the electrical contact 31 of the apparatus main assembly, and also the power routing member 37 of the image forming apparatus main assembly A.

The control circuit 202 is provided with a referential capacity element Cb, which is connected to the development bias circuit 202, in the image forming apparatus main assembly A. The referential capacity element Cb uses the AC current I1 supplied from the development bias circuit 201 to set up a referential voltage V1 for detecting the developer amount. In the control circuit 202, the AC current I1 supplied to the referential capacity element Cb is divided by the volume VR1, creating AC current I1', which is used to set up the referential voltage V1 by adding the amount V2 by which voltage is reduced by a resistor R2, to the voltage V3 set up by resistors R3 and R4.

The amplification circuit 204 is provided with a comparator for calculating a voltage difference; the AC current I2 applied to the detecting portion 80 is inputted into the amplification circuit 204, and is outputted as the detected value V4 (V1–I2xR5) of the developer amount. This output value is used as the detected value of the amount of the remaining developer. The information regarding the amount of the remaining developer detected as described above is reported to a user through a display (unshown) with which the image forming apparatus main assembly A is provided.

In the case of the image forming apparatus in this embodiment, the remaining amount of the developer in the process cartridge B is continually detected, and the amount of the developer consumption can be displayed based on the information regarding the remaining amount of the developer. Therefore, it is possible to prompt a user to prepare a brand-new process cartridge. Further, it is possible to prompt a user to replace the process cartridge, based on the detected information that there is no developer in the process cartridge B in the image forming apparatus main assembly A.

Description of Structure for Electrode Attachment

Figure 8:
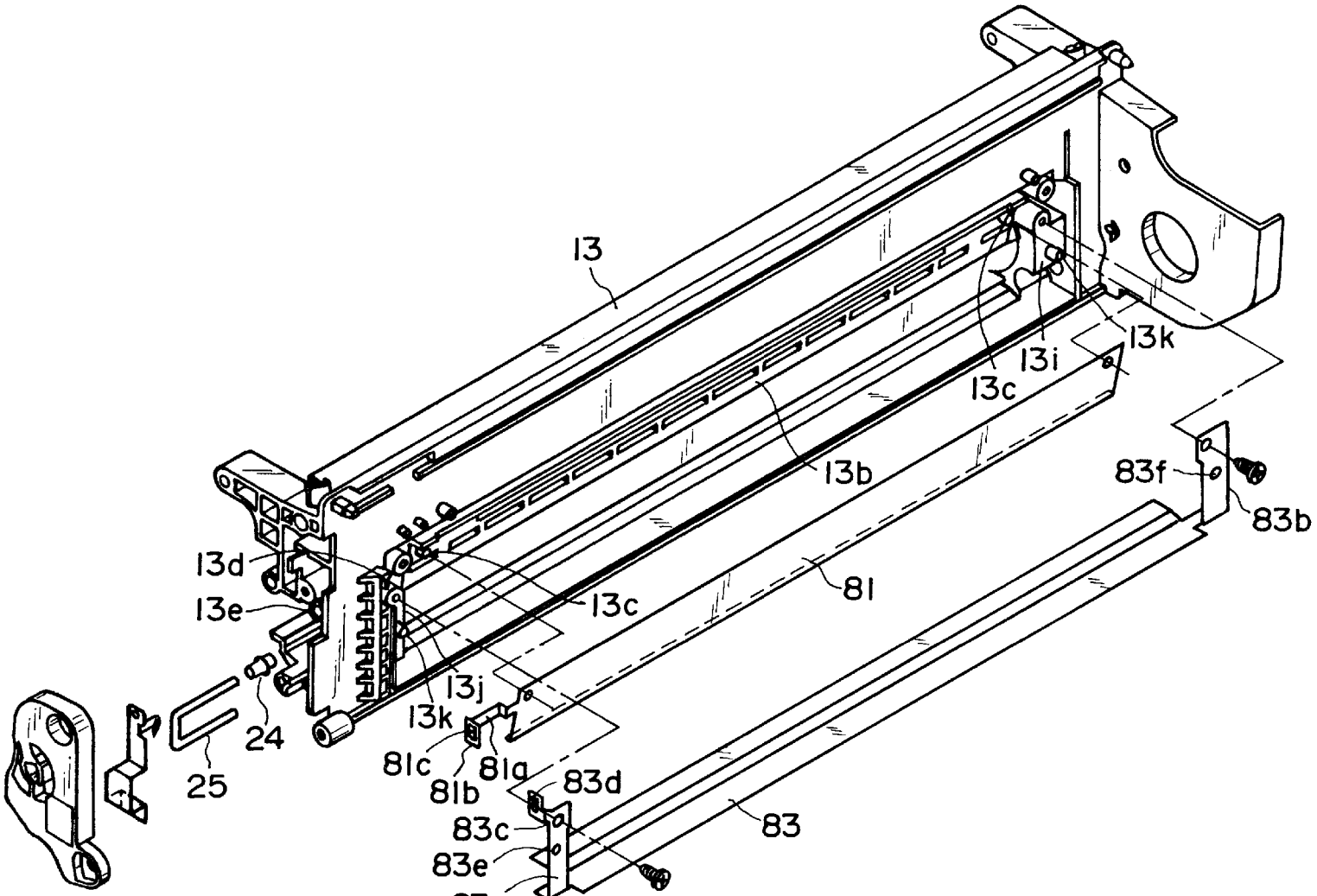
FIG. 8 is a partially exploded perspective view of the developing means holding frame in the embodiment of the present invention, for showing how the first and third electrodes are attached to the developing means holding frame.
Figure 9:
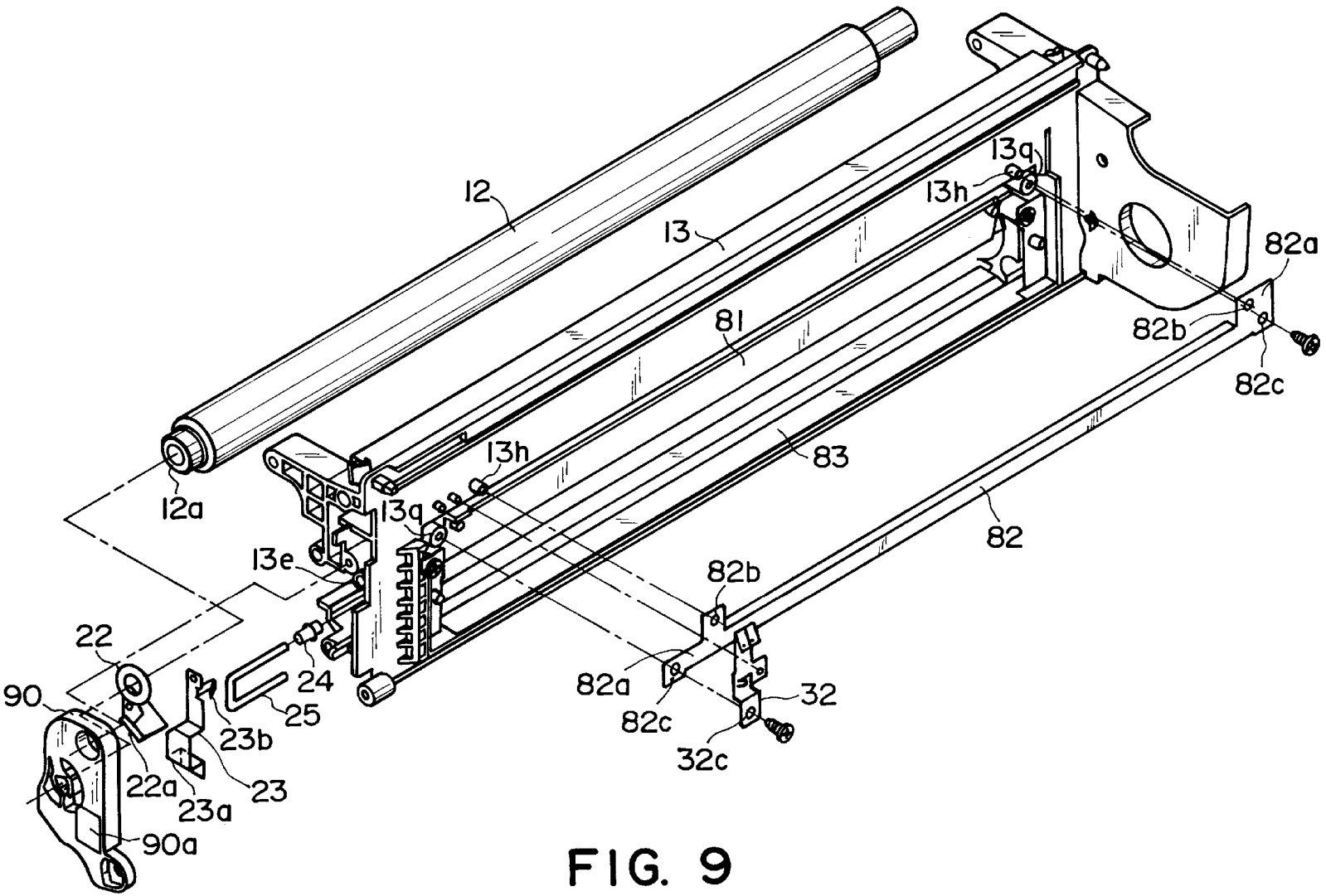
FIG. 9 is a partially exploded perspective view of the developing means holding frame in the embodiment of the present invention, for showing how the second electrode is attached to the developing means holding frame.

Next, referring to FIGS. 8 and 9, the structure for attaching the first, second, and third electrodes 81, 82, and 83 of the developer amount detecting means, to the developing apparatus structure, is shown. The developer amount detecting means comprising the first, second, and third electrodes 81, 82, and 83 detects the developer amount by detecting the electrostatic capacity of the space between the first and second electrodes 81 and 82, and the space between the third and second electrodes 83 and 82. Therefore, the positional accuracy of each electrode is extremely important. Further, one of the objects of the developer amount detecting means is to accurately detect when the formation of an image with unintended white spots begins due to the depletion of the developer. Thus, each electrode should be disposed close to the development roller 12 which will be in contact with the developer until the developer is completely depleted. This is why the electrodes 81, 82, and 83 in this embodiment are attached to the development frame, that is, developing means holding frame 13 as shown in FIGS. 8 and 9.

First and Third Electrodes

FIG. 8 is a perspective view of the developing means holding frame 13 for showing how the first and third electrodes 81 and 83 are attached to the developing means holding frame 13. As shown in the drawing, the first electrode 81 is accurately positioned relative to the developing means holding frame 13 by the positioning bosses 13*c* on the electrode attachment surface 13*b* of the developing means holding frame 13, and is pasted to the surface 13*b* with the use of two-sided tape. One of the lengthwise ends of the first electrode 81 is provided with an arm portion 81*a*, and the end of the arm portion 81*a* is partially cut and bent upright, forming a portion 81*b*, which fits into the groove 13*d* of the developing means holding frame 13. Next to the groove 13*d* of the developing means holding frame 13, a side hole 13*e* is provided, which extends from the inward side of the developing means holding frame 13 to the outward side of the developing means holding frame 13, and the position of which corresponds to the hole 81*c* of the uprightly bent portion 81*b*.

The third electrode 83 is a piece of thin plate. The lengthwise ends of the third electrode 83 are provided with arm portions 83*a* and 83*b*, one for one, which are virtually perpendicular to the main portion of the third electrode 83 between the two arm portions 83*a* and 83*b*. The arm portions 83*a* and 83*b* are provided with positioning holes 83*e* and 83*f*, respectively, into which the positioning bosses 13*k* fit, one for one. The end of the arm portion 83*a* is cut and bent upright, forming a portion 83*c*, which is virtually perpendicular to the main section of the arm portion 83*a* and the main section of the third electrode 83. This uprightly bent portion 83*c* of the arm portion 83*a* of the third electrode 83 is the same in shape as the uprightly bent portion 81*b* of the first electrode 81. In order to attach the third electrode 83 to the developing means holding frame 13, first, the positioning bosses 13*k* are put through the positioning holes 83*e* and 83*f* of the arm portion 83*a* and 83*b*, one for one, placing the arm portions 83*a* and 83*b* in contact with the electrode attachment surfaces 13*i* and 13*j*, respectively, and then, it is secured with the use of screws.

During the above process, the end portion of the arm portion 83*a* with the uprightly bent portion 83*c* fits into the groove 13*d* of the developing means holding frame 13. The uprightly bent portion 83*c* is provided with a hole 83*d*, which is positioned next, and parallel, to the uprightly bent portion 81*b*, as the third electrode 83 is attached to the developing means holding frame 13.

The side hole 13*e* of the developing means holding frame 13 is matched in shape and size to an elastic seal 24 to accommodate the elastic seal 24, which is pressed into the side hole 13*e* from the outward side of the developing means holding frame 13. After the insertion of the elastic seal 24 into the side hole 13*e*, a U-shaped electrode 25 formed of a piece of cylindrical rod is inserted into the side hole 13*e*, and more precisely, the hole of the elastic seal 24, of the developing means holding frame 13, and then, the holes 81*c* and 83*d*, within the developing means holding frame 13. As a result, the first electrode 81, the third electrode 83, and the electrode 25, become electrically connected.

Second Electrode

FIG. 9 is a drawing for showing how the second electrode is attached to the developing means holding frame 13. As shown in FIG. 9, the second electrode 82 is formed of a piece of a thin plate, and is virtually perpendicularly bent in terms of the direction perpendicular to the lengthwise direction of the process cartridge B. It has a pair of arm portions 82*a*, which are located at its lengthwise ends, one for one. Each arm portion 82*a* of the second electrode 82 is provided with a positioning hole 82*b*, in which the positioning boss 13*h* of the developing means holding frame 13 fits, and a screw hole 82*c*.

In order to attach the second electrode 82 to the developing means holding frame 13, first, the bosses 13*h* of the developing means holding frame 13 are fitted into the corresponding positioning holes 82*b* of the second electrode 82 to accurately position the second electrode 82 relative to the developing means holding frame 13, and then, a pair of small screws are screwed into the corresponding holes 13*q* with a female thread, through the corresponding screw holes 82*c*, securing thereby the second electrode 82 to the developing means holding frame 13. During this process, one of the small screws (screw on the front side in FIG. 9) is put through the screw hole 32*c* of a plate electrode 32 so that the plate electrode 32 is placed in contact with the second electrode 82 as it is secured to the developing means holding frame 13. The plate electrode 32 provides the outward electrical connection for the second electrode 82. In order to prevent the presence of the second electrode 82 from interfering with the process for attaching the first electrode 81, it is desired that the second electrode 82 is attached after the attachment of the first electrode 81.

Thereafter, a holder 90, which rotationally supports the development roller 12 with the interposition of a bearing, is attached to one of the lengthwise ends of the developing means holding frame 13 as shown in FIG. 9 (development roller 12 is placed in the holder 90 after the joining of the developing means holding frame 13 and developer holding frame 11 by ultrasonic welding, which will be described later). To this holder 90, a plate output electrode 23 for placing the image forming apparatus A electrically in contact with the process cartridge B, and a development bias electrical contact member 22 for supplying development bias voltage to the development roller 12, are attached.

In the virtually square hole 90*a*, with which the holder 90 is provided, a part of the plate electrode 23, which constitutes the output electrical contact 23*a* for placing the image forming apparatus A electrically in contact with the process cartridge B, is fitted. The output plate electrode 23 is provided with a contact portion 23*b*. As the holder 90 is attached to the developing means holding frame 13, the contact portion 23*b* comes into contact with the cylindrical electrode 25, placing the output electrical contact 23*a* electrically in contact with the first and third electrodes 81 and 83.

To the holder 90, the development bias contact member 22 is attached, electrically connecting the image forming apparatus A and the development roller 12. The development bias contact member 22 is provided with the development bias electrical contact 22*a* and a contact portion. As the holder 90 is attached to the developing means holding frame 13, the contact portion comes into contact with the sleeve electrode 12*a* attached to the development roller 12, becoming electrically connected to the sleeve electrode 12*a*.

As described above, the second electrode 82 is different in electrical potential level from the first and third electrodes 81 and 83. Thus, if the second electrode 82 is placed in a manner to oppose the first electrode 81 or third electrode 83, static electricity is induced between them. This is also true with power routing electrodes. In other words, even if the power routing plate electrode for the second electrode 82 is placed in a manner to oppose the first electrode 81 and/or third electrode 83, static electricity is induced between the power routing plate electrode and the first electrode 81 and/or third electrode 83, reducing the accuracy with which the amount of the remaining developer is detected. Incidentally, the term "power routing plate electrode" means a plate electrode, the sole function of which is to conduct electrical power from one point to another. Since the plate electrode 32 is the power routing plate electrode for the second electrode 82, it is routed from the developing means holding frame 13 to the developer holding frame 11 in such a manner that it does not oppose the power routing plate electrode 23 for the first and third electrodes 81 and 83.

Figure 10:
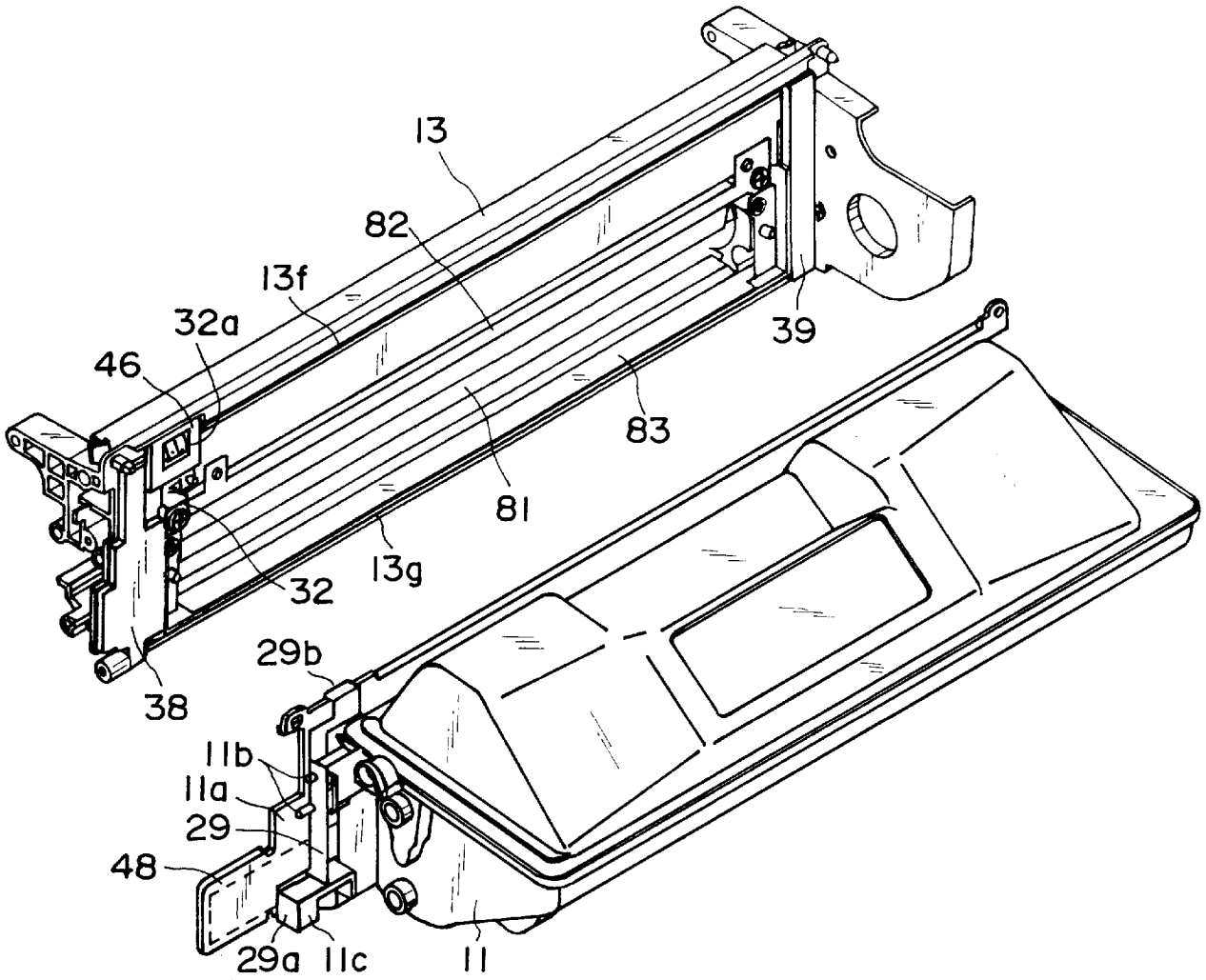
FIG. 10 is a perspective view of the developing holding frame and developer container in the embodiment of the present invention, for showing how the developing means holding frame and developer container are joined with each other after the attachment of the first to third electrodes to the developing means holding frame.
Figure 11:
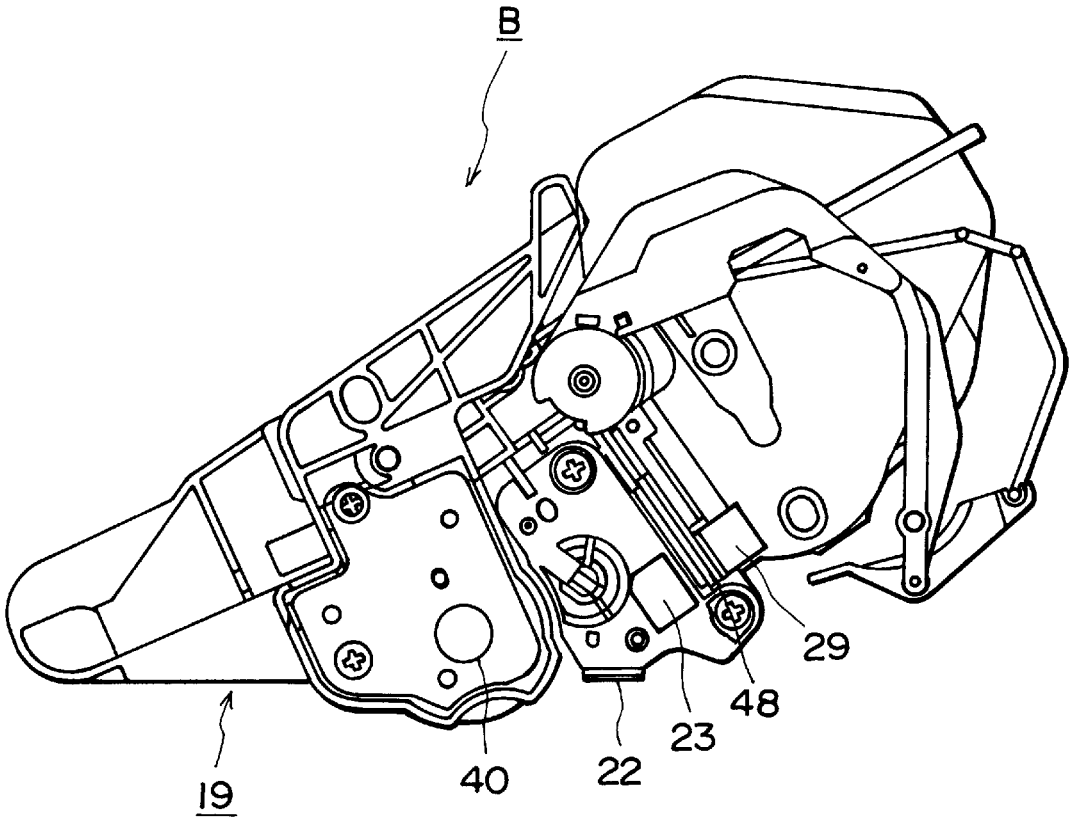
FIG. 11 is a side view of the process cartridge B, for showing the positioning of the external electrical contacts.

Next, referring to FIG. 10, the structure for keeping the developing means holding frame 13 joined with the developer holding means 11 having the developer storing portion 14 will be described. FIG. 10 is a perspective view of the developing means holding frame 13 and developer holding means 11, for showing how the two frames are joined with each other after the attachment of the first to third electrodes 81, 82, and 83 to the developing means holding frame 13.

As shown in FIG. 10, to the surface of the developer holding frame 11, by which the developer holding frame 11 is joined with the developing means holding frame 13, a developer seal 48 for sealing the developer supplying opening of the developer holding frame 11 is attached (which is shown in a broken line, since it is attached to the hidden side of the developer holding frame 11 in the drawing). The surface of the developing means holding frame 13, by which the developing means holding frame 13 is joined with the developer holding frame 11, is provided with ribs 13*f* and 13*g*, which fit into the grooves (unshown) with which the developer holding frame 11 is provided. The ribs 13*f* and 13*g* are located in the adjacencies of the top and bottom edges, respectively, of the developer supplying opening of the developing means holding frame 13, and extend in parallel in the lengthwise direction of the developing means holding frame 13. The top surface of each of the ribs 13*f* and 13*g* is provided with a triangular rib for ultrasonic welding.

To the lengthwise ends of the developing means holding frame 13, sealing members 38 and 39 are pasted to prevent the developer from leaking from between the developing means holding frame 13 and developer holding frame 11. Further, in order to prevent the developer from leaking from around the power routing plate electrode 32 for conducting electric power to the developer holding frame 11, a sealing member 46 is pasted to the developing means holding frame 13 in a manner to surround the contact portion 32*a* of the plate electrode 32. Incidentally, the sealing members 38, 39, and 46 are formed of an elastic spongy substance.

After the placement of various components into the developer holding frame 11 and developing means holding frame 13, ultrasonic vibrations are applied to the two frames while pressing them upon each other, with the ribs 13*f* and 13*g* of the developing means holding frame 13 fitted in the corresponding grooves of the developer holding frame 11. Consequently, the aforementioned triangular top ribs of the ribs 13*f* and 13*g* are melted by the ultrasonic vibrations, and weld to the bottoms of the grooves; in other words, the developer holding frame 11 and developing means holding frame 13 are welded to each other.

In the case of this structural arrangement, a power routing plate electrode 29 is attached to the developer holding frame 11. The plate electrode 29 is provided with an input electrical contact 29*a* for making connection with the image forming apparatus main assembly A, and a contact portion 29*b* for making connection with the plate electrode 32. The plate electrode 29 is attached to the exterior of the developer holding frame 11, with its contact portion 29*b* being positioned in a manner to clasp the lengthwise end portion of the flange 11*a* of the developer holding frame 11 and oppose the contact portion 32*a*. Further, the plate electrode 29 is extended following the outward side of the flange 11*a* of the developer holding frame 11, and a joggle 11*b* protruding, in the lengthwise direction of the developer holding frame 11, from the lengthwise end surface of the developer holding frame 11, is fitted in the hole of the plate electrode 29, securing thereby the plate electrode 29 to the developer holding frame 11. The input contact portion 29*b* of the plate electrode 29 is bent so that it conforms to the contact seat 11*c* of the developer holding frame 11. The surface of the input electrical contact 29*a*, which constitutes the actual electrical contact, faces outward, like the output electrical contact 23*a*, in terms of the lengthwise direction of the process cartridge B.

The electrical connection between the plate electrode 29 and plate electrode 32 is made by the contact between the contact portion 29*b* and contact portion 32*a*, which physically come into contact with each other, becoming thereby electrically connected with each other, as the developing means holding frame 13 and developer holding frame 11 are joined with each other. The plate electrode 29 is disposed so that the plane of the main section of the electrode 29 becomes virtually perpendicular to the plane of the arm portion 83*a* of the third electrode 83, preventing the surface of the main section of the electrode 29 from facing the surface of the arm portion 83*a* of the third electrode 83. In other words, the utmost effort is made not to induce static electricity between the plate electrode 29 and arm portion 83*a*. The plate electrodes 23 and 29 are also disposed so that their surfaces do not oppose each other. Further, the two plate electrodes 29 and 23 are disposed on the developing means holding frame 13 side and developer holding frame 11 side, respectively, preventing static electricity from being induced between the two electrodes 29 and 23.

In other words, in the case of the process cartridge B in this embodiment, the power routing plate electrode 32 is attached to the developing means holding frame 13, avoiding the situation that the plate electrode 29 on the voltage application side and the plate electrode on the power output side are attached to the same frame. Therefore, static electricity is not induced between the plate electrodes 29 and 23, preventing the reduction in the accuracy with which the amount of the remaining developer is detected.

Figure 12:
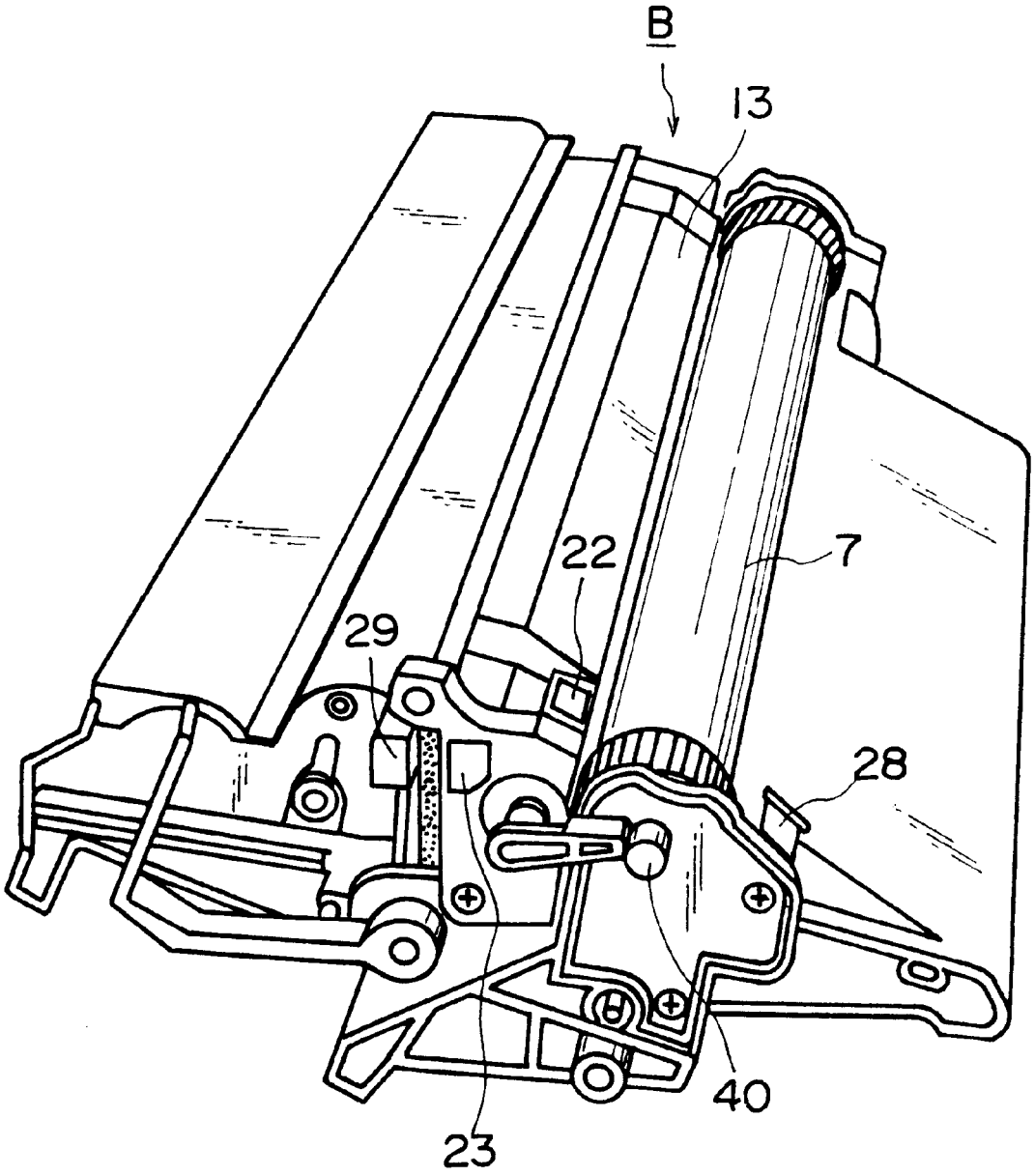
FIG. 12 is a perspective view of the process cartridge B as seen from below.

Referring to FIGS. 12 and 13, after the above described process cartridge assembly processes, the output and input electrical contacts 23*a* and 29*a* of the developer amount detecting means are attached to the process cartridge B, close to each other, being separated by the developer seal placed between the developing means holding frame 13 and developer holding frame 11. The external electrical contact point 22*a* of the development bias electrical contact member 22 is disposed on the bottom surface of the process cartridge B. Further, the ground electrical contact 40 and charge bias electrical contact member 28 are disposed on the side and bottom surfaces, respectively, of the cleaning unit 19.

Referring to FIG. 3, the image forming apparatus A is provided with electrical contacts 30 and 31, which make contact with the input and output electrical contacts 29*a* and 23*a*, respectively, of the developer amount detecting means. The electrical contacts 30 and 31 are attached to an electrical contact holder 42, forming an electrical contact unit 43, which is attached to the frame of the image forming apparatus main assembly A. The image forming apparatus A is also provided with electrical contacts 103 and 44 which make contact with the development bias electrical contact member 22 and charge bias electrical contact member 28 of the process cartridge B. The electrical contacts 103 and 44 project upward from the internal surface of the bottom wall of the image forming apparatus A. Further, the image forming apparatus A is provided with a ground electrical contact member 45 which makes contact with the grounding contact 40, and which is attached to the internal surface of the side wall of the image forming apparatus main assembly A, in a manner to align with the positioning groove 26*b*L (into which the drum shaft 27 fits) of the guide rail 26L in terms of the lengthwise direction of the process cartridge B. The grounding electrical contact member 45 is grounded through the apparatus main assembly chassis.

As the process cartridge B is inserted into the image forming apparatus main assembly A in the direction indicated by an arrow mark X, the input and output electrical contacts 23*a* and 29*a* of the developer amount detecting means come physically into contact, being therefore electrically connected, with the electrical contacts 30 and 31, respectively, on the internal surface of one the side walls of the image forming apparatus main assembly A. Further, the development bias electrical contact 22*a* and charge bias electrical contact 28*a*, come physically in contact, being therefore electrically connected, with the electrical contacts 103 and 44 protruding from the internal surface of the bottom wall of the image forming apparatus main assembly. Further, the grounding contact 40 comes physically in contact, being therefore electrically connected, with the grounding contact member on the apparatus main assembly side (FIG. 5).

The above described structure of the process cartridge can be summarized as follows.

The process cartridge B removably mountable in the main assembly of an electrophotographic image forming apparatus A comprises:

- the electrophotographic photoconductive drum 7;
- the charge roller 8 for charging the electrophotographic photoconductive drum 7;
- the development roller 12 for developing an electrostatic latent image formed on the electrophotographic photoconductive drum 7;
- the input electrode 82 extending in the lengthwise direction of the development roller 12, along the development roller 12;
- the output electrode 81 extending in the lengthwise direction of the development roller 12, along the development roller 12; and
- the grounding contact 40 which is for keeping the photoconductive drum 7 grounded to the apparatus main assembly when the process cartridge B is in the apparatus main assembly, and which is exposed from one end of the cartridge frame 50 in terms of the lengthwise direction of the photoconductive drum 7, with its center coinciding with the axial line of the photoconductive drum 7;
- the charge bias electrical contact 28*a* which is for receiving the charge bias from the apparatus main assembly and applying the received charge bias to the charge roller 8, and which is exposed from one end of the cartridge frame 50 in terms of the lengthwise direction of the photoconductive drum 7, in such a manner that it faces downward when the process cartridge B is in the apparatus main assembly;

the development bias electrical contact 22*a* which is for receiving the development bias from the apparatus main assembly and applying the received development bias to the development roller 12, and which is exposed from one end of the cartridge frame 50 in terms of the lengthwise direction of the photoconductive drum 7, being positioned opposite to the charge bias electrical contact 28*a* with respect to the photoconductive drum 7 in terms of the direction perpendicular to the lengthwise direction of the photoconductive drum 7, in such a manner that it faces downward when the process cartridge B is in the apparatus main assembly;

the input electrical contact 29*a* which is for receiving the input bias from the apparatus main assembly and applying the received input bias to the input electrode 82, and which is exposed from one of the end walls of the cartridge frame 50 in terms of the lengthwise direction of the photoconductive drum 7;

the output electrical contact 23*a* which is for transmitting to the apparatus main assembly, the output value reflecting the electrostatic capacity between the input electrode 82 and output electrode 81, and the electrostatic capacity between the development roller 12 and output electrode 81, in order to enable the apparatus main assembly to continually detect the amount of the developer remaining in the process cartridge B, and which is exposed from one of the end walls of the cartridge frame 50 in terms of the lengthwise direction of the photoconductive drum 7.

To the input electrode 82, an AC bias is applied through the input electrode 29*a*.

The cartridge frame 50 comprises the developer holding frame 11 having the developer holding portion 14 for holding the developer used by the development roller 12 for developing an electrostatic latent image, the developing means holding frame 13 for supporting the development roller 12, and the drum holding frame 21 for supporting the photoconductive drum 7 and charge roller 8. The input electrical contact 29*a* is attached to the developer holding frame 11, and the output electrical contact 23*a* is attached to the developing means holding frame 13.

The process cartridge B has the developer supplying opening 47 for supplying the developer held in the developer holding portion 14, to the development roller 12. The input electrical contact 29*a* is disposed on one side of the path through which the developer seal 48, which is sealing the developer supplying opening 47, is pulled out, whereas the output electrical contact 23*a* is disposed on the other side.

The input electrode 82 is attached to the developer holding frame 11, whereas the output electrode 81 is attached to the developing means holding frame 13.

The grounding contact 40 and the charge bias electrical contact 28*a* are attached to the drum holding frame 21, whereas the development bias electrical contact 22*a* is attached to the developing means holding frame 13.

The development bias electrical contact 22*a* is also used for receiving the development bias applied to the development roller 12, in order to detect the value reflecting the electrostatic capacity between the development roller 12 and output electrode 81.

According to the above described embodiment of the present invention, the output electrical contact 23*a* and input electrical contact 29*a* are disposed on the same end of the process cartridge B in terms of the lengthwise direction of the photoconductive drum 7, close to each other. Therefore, the electrical contact unit 43 which is attached to the image forming apparatus main assembly A can be reduced in size, which in turn makes it possible to reduce the size and cost of the image forming apparatus main assembly A.

The charge bias electrical contact 28*a*, the development bias electrical contact 22*a*, the grounding contact 40, the input electrical contact 29*a*, and the output electrical contact 23*a* are all disposed on the same lengthwise end of the process cartridge B. Therefore, it is possible to reduce the distance the wiring for connecting the high voltage circuit of the image forming apparatus main assembly to the process cartridge B must be routed, which in turn makes it possible to reduce the size and cost of the image forming apparatus A.

Further, it is possible to reduce the distance the power routing members 36 and 37 must be routed to connect the electrical contact unit 48 to the developer amount detection circuit 200. Therefore, it is possible to prevent the problem that the developer amount detection accuracy is reduced by the instability in the electrostatic capacities among the power routing members.

As described above, according to this embodiment of the present invention, the output electrical contact 23*a* and the input electrical contact 29*a* are disposed at the same end of the process cartridge B in terms of the lengthwise direction of the photoconductive drum 7, close to each other. Therefore, the electrical contact unit 43 provided on the image forming apparatus main assembly A side in correspondence to the electrical contacts 23*a* and 29*a* can be reduced in size, which in turns makes it possible to reduce the size and cost of the image forming apparatus A.

Further, the charge bias electrical contact 28*a*, the development bias electrical contact 22*a*, the grounding electrical contact 40, the input electrical contact 29*a*, and the output electrical contact 23*a* are all disposed on the same lengthwise end of the process cartridge B. Therefore, it is possible to reduce the distance the power routing members for connecting the high voltage circuit of the image forming apparatus main assembly to the process cartridge B must be routed, which in turn makes it possible to reduce the size and cost of the image forming apparatus A.

Further, it is possible to reduce the distance the power routing members 36 and 37 must be routed to connect the electrical contact unit 48 to the developer amount detection circuit 200. Therefore, it is possible to prevent the problem that the developer amount detection accuracy is reduced by the instability in the electrostatic capacities among the power routing members.

According to the present invention, each of the various electrical contacts of a process cartridge could be optimally positioned, making it possible to reduce a process cartridge in size.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus, comprising:

an electrophotographic photosensitive drum;

a charging roller configured and positioned to electrically charge said electrophotographic photosensitive drum;

a developing roller configured and positioned to develop an electrostatic latent image formed on said electrophotographic photosensitive drum;

an input electrode extending along a longitudinal direction of said developing roller;

an output electrode extending along the longitudinal direction of said developing roller;

a grounding contact configured and positioned to electrically ground said photosensitive drum to the main assembly of the apparatus when said cartridge is mounted to the main assembly of the apparatus, said grounding contact being exposed at an end surface of a cartridge frame provided at one longitudinal end of said photosensitive drum and being disposed across an axis of said photosensitive drum;

a charging bias contact configured and positioned to receive a charging bias voltage to be applied to said charging roller from the main assembly of the apparatus when said cartridge is mounted to the main assembly of the apparatus, said charging bias contact being exposed and facing downwardly adjacent said one longitudinal end of said photosensitive drum when said cartridge is mounted to the main assembly of the apparatus;

a developing bias contact configured and positioned to receive a developing bias to be applied to said developing roller from the main assembly of the apparatus when said cartridge is mounted to the main assembly of the apparatus, said developing bias contact being exposed and facing downwardly adjacent said one longitudinal end of said photosensitive drum when said cartridge is mounted to the main assembly of the apparatus, and said developing bias contact being disposed at a side opposite from said charging bias contact with said photosensitive drum interposed therebetween with respect to a direction crossing a longitudinal direction of said photosensitive drum;

an input electrical contact configured and positioned to receive an input bias to be applied to said input electrode from the main assembly of the apparatus when said cartridge is mounted to the main assembly of the apparatus, said input electrical contact being exposed at the end surface of the cartridge frame provided adjacent said one longitudinal end of said photosensitive drum; and an output electrical contact configured and positioned to transmit, to the main assembly of the apparatus, an output produced on the basis of a value corresponding to an electrostatic capacity between said input electrode and said output electrode and an electrostatic capacity between said developing roller and said output electrode so that the main assembly of the apparatus can detect in substantially real time a remaining amount of the developer in said cartridge when said cartridge is mounted to the main assembly of the apparatus, said output electrical contact being exposed at the end surface of the cartridge frame.

2. A process cartridge according to claim 1, wherein said input electrode is supplied with an AC bias voltage from said input electrical contact.

3. A process cartridge according to claim 1 or 2, wherein the cartridge frame includes a developer frame containing a developer accommodating portion configured and positioned to accommodate the developer to be used by said developing roller to develop the electrostatic latent image, a developing device frame supporting said developing roller, and a drum frame supporting said photosensitive drum and said charging roller, wherein said input electrical contact is provided on the developer frame, and said output electrical contact is provided on the developing device frame.

4. A process cartridge according to claim 3, further comprising a developer supply opening configured and positioned to supply the developer accommodated in the developer accommodating portion to said developing roller, wherein said input electrical contact and said output electrical contact are juxtaposed with a pulling path on which a developer seal sealing said developer supply opening is pulled.

5. A process cartridge according to claim 4, wherein said input electrode is provided on the developer frame, and said output electrode is provided on the developing device frame.

6. A process cartridge according to claim 5, wherein said grounding contact and said charging bias contact are provided on the drum frame, and said developing bias contact is provided on the developing device frame.

7. A process cartridge according to claim 1 or 2, wherein said developing bias contact is used also to receive from the main assembly of the apparatus a developing bias to be applied to said developing roller to detect the value corresponding to the electrostatic capacity between said developing roller and said output electrode.

8. An electrophotographic image forming apparatus for forming an image on a recording material, to which a process cartridge is detachably mountable, said apparatus comprising:

(a) a main assembly grounding contact;

(b) a main assembly developing bias contact;

(c) a main assembly charging bias contact;

(d) a main assembly input electrical contact;

(e) a main assembly output input electrical contact; and (f) a mounting portion configured and positioned to detachably mount the process cartridge, the process cartridge including:

an electrophotographic photosensitive drum;

a charging roller configured and positioned to electrically charge the electrophotographic photosensitive drum;

a developing roller configured and positioned to develop an electrostatic latent image formed on the electrophotographic photosensitive drum;

an input electrode extending along a longitudinal direction of the developing roller;

an output electrode extending along the longitudinal direction of the developing roller;

a grounding contact configured and positioned to electrically connect with said main assembly grounding contact to electrically ground the photosensitive drum to a main assembly of said apparatus when the cartridge is mounted to the main assembly of said apparatus, the grounding contact being exposed at an end surface of a cartridge frame provided at one longitudinal end of the photosensitive drum and being disposed across an axis of the photosensitive drum;

a charging bias contact configured and positioned to electrically connect with said main assembly charging bias contact to receive a charging bias voltage to be applied to the charging roller from the main assembly of said apparatus when the cartridge is mounted to the main assembly of said apparatus, the charging bias contact being exposed and facing downwardly adjacent one longitudinal end of the photosensitive drum when the cartridge is mounted to the main assembly of said apparatus;

a developing bias contact configured and positioned to electrically connect with said main assembly developing bias contact to receive a developing bias to be applied to the developing roller from the main assembly of said apparatus when the cartridge is mounted to the main assembly of said apparatus, the developing bias contact being exposed and facing downwardly adjacent one longitudinal end of the photosensitive drum when the cartridge is mounted to the main assembly of said apparatus, and the developing bias contact being disposed at a side opposite from the charging bias contact with the photosensitive drum interposed therebetween with respect to a direction crossing a longitudinal direction of the photosensitive drum;

an input electrical contact configured and positioned to electrically connect with said main assembly input electrical contact to receive an input bias to be applied to the input electrode from the main assembly of said apparatus when the cartridge is mounted to the main assembly of said apparatus, the input electrical contact being exposed at the end surface of the cartridge frame provided adjacent a longitudinal end of the photosensitive drum; and an output electrical contact configured and positioned to electrically connect with said main assembly output contact to transmit, to the main assembly of said apparatus, an output produced on the basis of a value corresponding to an electrostatic capacity between the input electrode and the output electrode and an electrostatic capacity between the developing roller and the output electrode so that the main assembly of said apparatus can detect in substantially real time a remaining amount of the developer in the cartridge when the cartridge is mounted to the main assembly of said apparatus, the output electrical contact being exposed at the end surface of the cartridge frame.

9. A process cartridge detachably mountable to a main assembly of an electrophotographic image forming apparatus, comprising:

an electrophotographic photosensitive drum;

a charging roller configured and positioned to electrically charge said electrophotographic photosensitive drum;

a developing roller configured and positioned to develop an electrostatic latent image formed on said electrophotographic photosensitive drum;

an input electrode extending along a longitudinal direction of said developing roller;

an output electrode extending along a longitudinal direction of said developing roller;

a grounding contact configured and positioned to electrically ground said photosensitive drum to a main assembly of the apparatus when said cartridge is mounted to the main assembly of the apparatus, said grounding contact being exposed at an end surface of a cartridge frame provided at one longitudinal end of said photosensitive drum and being disposed across an axis of said photosensitive drum;

a charging bias contact configured and positioned to receive a charging bias voltage to be applied to said charging roller from the main assembly of the apparatus when said cartridge is mounted to the main assembly of the apparatus, said charging bias contact being exposed and facing downwardly adjacent one longitudinal end of said photosensitive drum when said cartridge is mounted to the main assembly of the apparatus;

a developing bias contact configured and positioned to receive a developing bias to be applied to said developing roller from the main assembly of the apparatus when said cartridge is mounted to the main assembly of the apparatus, said developing bias contact being exposed and facing downwardly adjacent one longitudinal end of said photosensitive drum when said cartridge is mounted to the main assembly of the apparatus, and said developing bias contact being disposed at a side opposite from said charging bias contact with said photosensitive drum interposed therebetween with respect to a direction crossing a longitudinal direction of said photosensitive drum;

an input electrical contact configured and positioned to receive an input bias to be applied to said input electrode from the main assembly of the apparatus when said cartridge is mounted to the main assembly of the apparatus, said input electrical contact being exposed at an end surface of the cartridge frame provided adjacent a longitudinal end of said photosensitive drum; and an output electrical contact configured and positioned to transmit, to the main assembly of the apparatus, an output produced on the basis of a value corresponding to an electrostatic capacity between said input electrode and said output electrode and an electrostatic capacity between said developing roller and said output electrode so that the main assembly of the apparatus can detect in substantially real time a remaining amount of the developer in said cartridge when said cartridge is mounted to the main assembly of the apparatus, said output electrical contact being exposed at an end surface of the cartridge frame, wherein the cartridge frame includes a developer frame containing a developer accommodating portion configured and positioned to accommodate the developer to be used by said developing roller to develop the electrostatic latent image, a developing device frame supporting said developing roller, and a drum frame supporting said photosensitive drum and a charging roller, wherein said input electrical contact is provided on the developer frame, and said output electrical contact is provided on the developing device frame, and wherein said developing bias contact is used also to receive from the main assembly of the apparatus a developing bias to be applied to said developing roller to detect the value corresponding to the electrostatic capacity between said developing roller and said output electrode.

10. A process cartridge according to claim 9, wherein said input electrode is supplied with an AC bias voltage from said input electrical contact.

11. A process cartridge according to claim 9 or 10, further comprising a developer supply opening configured and positioned to supply the developer accommodated in the developer accommodating portion to the developing roller, wherein the input electrical contact and the output electrical contact are juxtaposed with a pulling path on which a developer seal sealing said developer supply opening is pulled.

12. A process cartridge according to claim 9 or 10, wherein the input electrode is provided on the developer frame, and the output electrode is provided on the developing device frame.

13. A process cartridge according to claim 12, wherein the grounding contact and the charging bias contact are provided on the drum frame, and the developing bias contact is provided on the developing device frame.

14. An electrophotographic image forming apparatus for forming an image on a recording material, to which a process cartridge is detachably mountable, said apparatus comprising:

(a) a main assembly grounding contact;

(b) a main assembly developing bias contact;

(c) a main assembly charging bias contact;

(d) a main assembly input electrical contact;

(e) a main assembly output input electrical contact; and (f) a mounting portion configured and positioned to detachably mount the process cartridge, the process cartridge including:

an electrophotographic photosensitive drum;

a charging roller configured and positioned to electrically charge the electrophotographic photosensitive drum;

a developing roller configured and positioned to develop an electrostatic latent image formed on the electrophotographic photosensitive drum;

an input electrode extending along a longitudinal direction of the developing roller;

an output electrode extending along a longitudinal direction of the developing roller;

a grounding contact configured and positioned to electrically connect with said main assembly grounding contact to electrically ground the photosensitive drum to a main assembly of said apparatus when the cartridge is mounted to the main assembly of said apparatus, the grounding contact being exposed at an end surface of a cartridge frame provided at one longitudinal end of the photosensitive drum and being disposed across an axis of the photosensitive drum;

a charging bias contact configured and positioned to electrically connect with said main assembly charging bias contact to receive a charging bias voltage to be applied to the charging roller from the main assembly of said apparatus when the cartridge is mounted to the main assembly of said apparatus, the charging bias contact being exposed and facing downwardly adjacent one longitudinal end of the photosensitive drum when the cartridge is mounted to the main assembly of said apparatus;

a developing bias contact configured and positioned to electrically connect with said main assembly developing bias contact to receive a developing bias to be applied to the developing roller from the main assembly of said apparatus when the cartridge is mounted to the main assembly of said apparatus, the developing bias contact being exposed and facing downwardly adjacent one longitudinal end of the photosensitive drum when the cartridge is mounted to the main assembly of said apparatus, and the developing bias contact being disposed at a side opposite from the charging bias contact with the photosensitive drum interposed therebetween with respect to a direction crossing a longitudinal direction of the photosensitive drum;

an input electrical contact configured and positioned to electrically connect with said main assembly input electrical contact to receive an input bias to be applied to the input electrode from the main assembly of said apparatus when the cartridge is mounted to the main assembly of said apparatus, the input electrical contact being exposed at an end surface of the cartridge frame provided adjacent a longitudinal end of the photosensitive drum; and an output electrical contact configured and positioned to electrically connect with said main assembly output contact to transmit, to the main assembly of said apparatus, an output produced on the basis of a value corresponding to an electrostatic capacity between the input electrode and the output electrode and an electrostatic capacity between the developing roller and the output electrode so that the main assembly of said apparatus can detect in substantially real time a remaining amount of the developer in the cartridge when the cartridge is mounted to the main assembly of said apparatus, the output electrical contact being exposed at an end surface of the cartridge frame, wherein the cartridge frame includes a developer frame containing a developer accommodating portion configured and positioned to accommodate the developer to be used by the developing roller to develop the electrostatic latent image, a developing device frame supporting the developing roller, and a drum frame supporting the photosensitive drum and a charging roller, wherein the input electrical contact is provided on the developer frame, and the output electrical contact is provided on the developing device frame, and wherein the developing bias contact is used also to receive from the main assembly of said apparatus a developing bias to be applied to the developing roller to detect the value corresponding to the electrostatic capacity between the developing roller and the output electrode.

15. A process cartridge detachably mountable to a main assembly of an electrophotographic image forming apparatus, comprising:

an electrophotographic photosensitive drum;

a charging roller configured and positioned to electrically charge said electrophotographic photosensitive drum;

a developing roller configured and positioned to develop an electrostatic latent image formed on said electrophotographic photosensitive drum;

an input electrode extending along a longitudinal direction of said developing roller;

an output electrode extending along a longitudinal direction of said developing roller;

a grounding contact configured and positioned to electrically ground said photosensitive drum to the main assembly of the apparatus when said cartridge is mounted to the main assembly of the apparatus, said grounding contact being exposed at an end surface of a cartridge frame provided at one longitudinal end of said photosensitive drum and being disposed across an axis of said photosensitive drum;

a charging bias contact configured and positioned to receive a charging bias voltage to be applied to said charging roller from the main assembly of the apparatus when said cartridge is mounted to the main assembly of the apparatus, said charging bias contact being exposed and facing downwardly adjacent one longitudinal end of said photosensitive drum when said cartridge is mounted to the main assembly of the apparatus;

a developing bias contact configured and positioned to receive a developing bias to be applied to said developing roller from the main assembly of the apparatus when said cartridge is mounted to the main assembly of the apparatus, said developing bias contact being exposed and facing downwardly adjacent one longitudinal end of said photosensitive drum when said cartridge is mounted to the main assembly of the apparatus, and said developing bias contact being disposed at a side opposite from said charging bias contact with said photosensitive drum interposed therebetween with respect to a direction crossing a longitudinal direction of said photosensitive drum;

an input electrical contact configured and positioned to receive an input bias to be applied to said input electrode from the main assembly of the apparatus when said cartridge is mounted to the main assembly of the apparatus, said input electrical contact being exposed at an end surface of the cartridge frame provided adjacent a longitudinal end of said photosensitive drum; and an output electrical contact configured and positioned to transmit, to the main assembly of the apparatus, an output produced on the basis of a value corresponding to an electrostatic capacity between said input electrode and said output electrode and an electrostatic capacity between said developing roller and said output electrode so that the main assembly of the apparatus can detect in substantially real time a remaining amount of the developer in said cartridge when said apparatus when said cartridge is mounted to the main assembly of the apparatus, said output electrical contact being exposed at an end surface of the cartridge frame, wherein the cartridge frame includes a developer frame containing a developer accommodating portion configured and positioned to accommodate the developer to be used by said developing roller to develop the electrostatic latent image, a developing device frame supporting said developing roller, and a drum frame supporting said photosensitive drum and a charging roller, wherein said input electrical contact is provided on the developer frame, and said output electrical contact is provided on the developing device frame, said process cartridge further comprising a developer supply opening configured and positioned to supply the developer accommodated in the developer accommodating portion to said developing roller, wherein said input electrical contact and said output electrical contact are juxtaposed with a pulling path on which a developer seal sealing said developer supply opening is pulled, wherein said input electrode is provided on the developer frame, and said output electrode is provided on the developing device frame, wherein said grounding contact and said charging bias contact are provided on the drum frame, and said developing bias contact is provided on the developing device frame, and wherein said developing bias contact is used also to receive from the main assembly of the apparatus a developing bias to be applied to said developing roller to detect the value corresponding to the electrostatic capacity between said developing roller and said output electrode.

16. A process cartridge according to claim 15, wherein said input electrode is supplied with an AC bias voltage from said input electrical contact.

17. An electrophotographic image forming apparatus for forming an image on a recording material, to which a process cartridge is detachably mountable, said apparatus comprising:

(a) a main assembly grounding contact;

(b) a main assembly developing bias contact;

(c) a main assembly charging bias contact;

(d) a main assembly input electrical contact;

(e) a main assembly output input electrical contact; and (f) a mounting portion for detachably mounting the process cartridge, the process cartridge including:

an electrophotographic photosensitive drum;

a charging roller configured and positioned to electrically charge the electrophotographic photosensitive drum;

a developing roller configured and positioned to develop an electrostatic latent image formed on the electrophotographic photosensitive drum;

an input electrode extending along a longitudinal direction of the developing roller;

an output electrode extending along a longitudinal direction of the developing roller;

a grounding contact configured and positioned to electrically connect with said main assembly grounding contact to electrically ground the photosensitive drum to a main assembly of said apparatus when the cartridge is mounted to the main assembly of said apparatus, the grounding contact being exposed at an end surface of a cartridge frame provided at one longitudinal end of the photosensitive drum and being disposed across an axis of the photosensitive drum;

a charging bias contact configured and positioned to electrically connect with said main assembly charging bias contact to receive a charging bias voltage to be applied to the charging roller from the main assembly of said apparatus when the cartridge is mounted to the main assembly of said apparatus, the charging bias contact being exposed and facing downwardly adjacent one longitudinal end of the photosensitive drum when the cartridge is mounted to the main assembly of said apparatus;

a developing bias contact configured and positioned to electrically connect with said main assembly developing bias contact to receive a developing bias to be applied to the developing roller from the main assembly of said apparatus when the cartridge is mounted to the main assembly of said apparatus, the developing bias contact being exposed and facing downwardly adjacent one longitudinal end of the photosensitive drum when the cartridge is mounted to the main assembly of said apparatus, and the developing bias contact being disposed at a side opposite from the charging bias contact with the photosensitive drum interposed therebetween with respect to a direction crossing a longitudinal direction of the photosensitive drum;

an input electrical contact configured and positioned to electrically connect with said main assembly input electrical contact to receive an input bias to be applied to the input electrode from the main assembly of said apparatus when the cartridge is mounted to the main assembly of said apparatus, the input electrical contact being exposed at an end surface of the cartridge frame provided adjacent a longitudinal end of the photosensitive drum; and an output electrical contact configured and positioned to electrically connect with said main assembly output contact to transmit, to the main assembly of said apparatus, an output produced on the basis of a value corresponding to an electrostatic capacity between the input electrode and the output electrode and an electrostatic capacity between the developing roller and the output electrode so that the main assembly of said apparatus can detect in substantially real time a remaining amount of the developer in the cartridge when the cartridge is mounted to the main assembly of said apparatus, the output electrical contact being exposed at an end surface of the cartridge frame, wherein the cartridge frame includes a developer frame containing a developer accommodating portion configured and positioned to accommodate the developer to be used by the developing roller to develop the electrostatic latent image, a developing device frame supporting the developing roller, and a drum frame supporting the photosensitive drum and a charging roller, wherein the input electrical contact is provided on the developer frame, and the output electrical contact is provided on the developing device frame, said process cartridge further comprising a developer supply opening configured and positioned to supply the developer accommodated in the developer accommodating portion to the developing roller, wherein the input electrical contact and the output electrical contact are juxtaposed with a pulling path on which a developer seal sealing said developer supply opening is pulled, wherein the input electrode is provided on the developer frame, and the output electrode is provided on the developing device frame, wherein the grounding contact and the charging bias contact are provided on the drum frame, and the developing bias contact is provided on the developing device frame, and wherein the developing bias contact is used also to receive from the main assembly of said apparatus a developing bias to be applied to the developing roller to detect the value corresponding to the electrostatic capacity between the developing roller and the output electrode.

18. A process cartridge detachably mountable to a main assembly of an electrophotographic image forming apparatus, comprising:

an electrophotographic photosensitive drum;

a charging roller configured and positioned to electrically charge said electrophotographic photosensitive drum;

a developing roller configured and positioned to develop an electrostatic latent image formed on said electrophotographic photosensitive drum;

an input electrode extending along a longitudinal direction of said developing roller;

an output electrode extending along a longitudinal direction of said developing roller;

a grounding contact configured and positioned to electrically ground said photosensitive drum to the main assembly of the apparatus when said cartridge is mounted to the main assembly of the apparatus, said grounding contact being exposed to an end surface of a cartridge frame provided at one longitudinal end of said photosensitive drum and being disposed across an axis of said photosensitive drum;

a charging bias contact configured and positioned to receive a charging bias voltage to be applied to said charging roller from the main assembly of the apparatus when said cartridge is mounted to the main assembly of the apparatus, said charging bias contact being exposed and facing downwardly adjacent one longitudinal end of said photosensitive drum when said cartridge is mounted to the main assembly of the apparatus;

a developing bias contact configured and positioned to receive a developing bias to be applied to said developing roller from the main assembly of the apparatus when said cartridge is mounted to the main assembly of the apparatus, said developing bias contact being exposed and facing downwardly adjacent one longitudinal end of said photosensitive drum when said cartridge is mounted to the main assembly of the apparatus, and said developing bias contact being disposed at a side opposite from said charging bias contact with said photosensitive drum interposed therebetween with respect to a direction crossing a longitudinal direction of said photosensitive drum;

an input electrical contact configured and positioned to receive an input bias to be applied to said input electrode from the main assembly of the apparatus when said cartridge is mounted to the main assembly of the apparatus, said input electrical contact being exposed at an end surface of the cartridge frame provided adjacent a longitudinal end of said photosensitive drum; and an output electrical contact configured and positioned to transmit, to the main assembly of the apparatus, an output produced on the basis of a value corresponding to an electrostatic capacity between said input electrode and said output electrode and an electrostatic capacity between said developing roller and said output electrode so that the main assembly of the apparatus can detect in substantially real time a remaining amount of the developer in said cartridge when said cartridge is mounted to the main assembly of the apparatus, said output electrical contact being exposed at an end surface of the cartridge frame, wherein said input electrode is supplied with an AC bias voltage from said input electrical contact, wherein the cartridge frame includes a developer frame containing a developer accommodating portion configured and positioned to accommodate the developer to be used by said developing roller to develop the electrostatic latent image, a developing device frame supporting said developing roller, and a drum frame supporting said photosensitive drum and a charging roller, wherein said input electrical contact is provided on the developer frame, and said output electrical contact is provided on the developing device frame, said process cartridge further comprising a developer supply opening configured and positioned to supply the developer accommodated in the developer accommodating portion to said developing roller, wherein said input electrical contact and said output electrical contact are juxtaposed with a pulling path on which a developer seal sealing said developer supply opening is pulled, wherein said input electrode is provided on the developer frame, and said output electrode is provided on the developing device frame, wherein said grounding contact and said charging bias contact are provided on the drum frame, and said developing bias contact is provided on the developing device frame, and wherein said developing bias contact is used also to receive from the main assembly of the apparatus a developing bias to be applied to said developing roller to detect the value corresponding to the electrostatic capacity between said developing roller and said output electrode.

19. An electrophotographic image forming apparatus for forming an image on a recording material, to which a process cartridge is detachably mountable, said apparatus comprising:

(a) a main assembly grounding contact;

(b) a main assembly developing bias contact;

(c) a main assembly charging bias contact;

(d) a main assembly input electrical contact;

(e) a main assembly output input electrical contact; and (f) a mounting portion configured and positioned to detachably mount the process cartridge, the process cartridge including:

an electrophotographic photosensitive drum;

a charging roller configured and positioned to electrically charge the electrophotographic photosensitive drum;

a developing roller configured and positioned to develop an electrostatic latent image formed on the electrophotographic photosensitive drum;

an input electrode extending along a longitudinal direction of the developing roller;

an output electrode extending along a longitudinal direction of the developing roller;

a grounding contact configured and positioned to electrically connect with said main assembly grounding contact to electrically ground the photosensitive drum to a main assembly of said apparatus when the cartridge is mounted to the main assembly of said apparatus, the grounding contact being exposed at an end surface of a cartridge frame provided at one longitudinal end of the photosensitive drum and being disposed across an axis of the photosensitive drum;

a charging bias contact configured and positioned to electrically connect with said main assembly charging bias contact to receive a charging bias voltage to be applied to the charging roller from the main assembly of said apparatus when the cartridge is mounted to the main assembly of said apparatus, the charging bias contact being exposed and facing downwardly adjacent one longitudinal end of the photosensitive drum when the cartridge is mounted to the main assembly of said apparatus;

a developing bias contact configured and positioned to electrically contact with said main assembly developing bias contact receiving a developing bias to be applied to the developing roller from the main assembly of said apparatus when the cartridge is mounted to the main assembly of said apparatus, the developing bias contact being exposed and facing downwardly adjacent one longitudinal end of the photosensitive drum when the cartridge is mounted to the main assembly of said apparatus, and the developing bias contact being disposed at a side opposite from the charging bias contact with the photosensitive drum interposed therebetween with respect to a direction crossing a longitudinal direction of the photosensitive drum;

an input electrical contact configured and positioned to electrically connect with said main assembly input electrical contact to receive an input bias to be applied to the input electrode from the main assembly of said apparatus when the cartridge is mounted to the main assembly of said apparatus, said input electrical contact being exposed at an end surface of the cartridge frame provided adjacent a longitudinal end of the photosensitive drum; and an output electrical contact configured and positioned to electrically connect with said main assembly output contact to transmit, to the main assembly of said apparatus, an output produced on the basis of a value corresponding to an electrostatic capacity between the input electrode and the output electrode and an electrostatic capacity between the developing roller and the output electrode so that the main assembly of said apparatus can detect in substantially real time a remaining amount of the developer in the cartridge when the cartridge is mounted to the main assembly of said apparatus, the output electrical contact being exposed at an end surface of the cartridge frame, wherein the input electrode is supplied with an AC bias voltage from the input electrical contact, wherein the cartridge frame includes a developer frame containing a developer accommodating portion configured and positioned to accommodate the developer to be used by the developing roller to develop the electrostatic latent image, a developing device frame supporting the developing roller, and a drum frame supporting the photosensitive drum and a charging roller, wherein the input electrical contact is provided on the developer frame, and the output electrical contact is provided on the developing device frame, said process cartridge further comprising a developer supply opening configured and positioned to supply the developer accommodated in the developer accommodating portion to the developing roller, wherein the input electrical contact and the output electrical contact are juxtaposed with a pulling path on which a developer seal sealing said developer supply opening is pulled, wherein the input electrode is provided on the developer frame, and the output electrode is provided on the developing device frame, wherein the grounding contact and the charging bias contact are provided on the drum frame, and the developing bias contact is provided on the developing device frame, and wherein the developing bias contact is used also to receive from the main assembly of said apparatus a developing bias to be applied to the developing roller to detect the value corresponding to the electrostatic capacity between the developing roller and said the output electrode.

* * * * *

UNITED STATES PATENT AND TRADEMARK OFFICE

CERTIFICATE OF CORRECTION

PATENT NO. : 6,804,475 B2
DATED : October 12, 2004
INVENTOR(S) : Toru Oguma et al.

It is certified that error appears in the above-identified patent and that said Letters Patent is hereby corrected as shown below:

Title page,
Item [56], References Cited, U.S. PATENT DOCUMENTS, insert
-- 5,812,909 9/1998…….Oguma et al. 399/103 --.

Column 5,
Line 18, "2" should read -- 2. --.

Column 7,
Line 37, "in" should be deleted.

Column 10,
Line 26, "of" should read -- of a --.

Column 12,
Line 37, "extend in" should read -- extend --.

Column 14,
Line 23, "one" should read -- one of --.

Column 16,
Line 26, "turns" should read -- turn --.

Column 23,
Line 18, "when said apparatus" should be deleted.

Column 28,
Line 54, "said" should be deleted.

Signed and Sealed this

Fourth Day of January, 2005

JON W. DUDAS
*Director of the United States Patent and Trademark Office*